US010546682B2

(12) United States Patent
Abe et al.

(10) Patent No.: US 10,546,682 B2
(45) Date of Patent: Jan. 28, 2020

(54) REACTOR AND STEP-UP CIRCUIT

(71) Applicant: TOKIN CORPORATION, Sendai-shi, Miyagi (JP)

(72) Inventors: Yuki Abe, Sendai (JP); Takashi Yanbe, Sendai (JP); Masahiro Kondo, Sendai (JP); Takuya Endou, Sendai (JP); Keisuke Akaki, Sendai (JP)

(73) Assignee: TOKIN CORPORATION, Tokyo (JP)

( * ) Notice: Subject to any disclaimer, the term of this patent is extended or adjusted under 35 U.S.C. 154(b) by 0 days.

(21) Appl. No.: 16/232,742

(22) Filed: Dec. 26, 2018

(65) Prior Publication Data

US 2019/0221360 A1 Jul. 18, 2019

(30) Foreign Application Priority Data

Jan. 17, 2018 (JP) ..... 2018-005438

(51) Int. Cl.

| | |
|---|---|
| ***H01F 27/24*** | (2006.01) |
| ***H01F 27/28*** | (2006.01) |
| ***H01F 27/02*** | (2006.01) |
| ***G05F 3/22*** | (2006.01) |

(52) U.S. Cl.

CPC ..... *H01F 27/2823* (2013.01); *G05F 3/22* (2013.01); *H01F 27/02* (2013.01); *H01F 27/24* (2013.01)

(58) Field of Classification Search

CPC ..... H01F 27/02; H01F 27/24; H01F 27/255; H01F 27/2823; H01F 27/2804; G05F 3/22

See application file for complete search history.

(56) References Cited

U.S. PATENT DOCUMENTS

| | | | | |
|---|---|---|---|---|
| 6,980,077 | B1 * | 12/2005 | Chandrasekaran | H01F 27/255 336/212 |
| 2012/0249105 | A1 * | 10/2012 | Nussbaum | H01F 27/2804 323/283 |
| 2012/0249280 | A1 * | 10/2012 | Nussbaum | H01F 27/2804 336/192 |
| 2013/0106500 | A1 * | 5/2013 | Yin | H01F 27/255 327/538 |
| 2015/0279552 | A1 * | 10/2015 | Ginglseder | H01F 27/255 336/178 |

FOREIGN PATENT DOCUMENTS

| | | | |
|---|---|---|---|
| JP | H10127049 | A | 5/1998 |
| JP | 2017143220 | A | 8/2017 |
| JP | 2017168587 | A | 9/2017 |

* cited by examiner

*Primary Examiner* — Gary L Laxton
*Assistant Examiner* — Jye-June Lee
(74) *Attorney, Agent, or Firm* — Holtz, Holtz & Volek PC

(57) ABSTRACT

A reactor comprises a first coil, a second coil and a core. Each of the first coil and the second coil is embedded in the core. The core has an outer core part, an inner core part, an upper core part, a lower core part and a middle core part. The upper core part is positioned above an upper end of a cross-section of the first coil in an up-down direction. The lower core part is positioned below a lower end of a cross-section of a second coil in the up-down direction. The core is made of a first member and a second member. The second member has a relative permeability which is greater than a relative permeability of the first member. Each of the upper core part and the lower core part is made of the second member.

14 Claims, 5 Drawing Sheets

REACTOR AND STEP-UP CIRCUIT

CROSS REFERENCE TO RELATED APPLICATIONS

This application is based on and claims priority under 35 U.S.C. § 119 to Japanese Patent Application No. JP2018-005438 filed Jan. 17, 2018, the contents of which are incorporated herein in their entirety by reference.

BACKGROUND OF THE INVENTION

This invention relates to a reactor comprising two coils and a core, and to a step-up circuit comprising the reactor.

There is a need for an interleaved step-up circuit utilizing a reactor because the interleaved step-up circuit can handle large current. An interleaved step-up circuit of this type, which utilizes a reactor, is disclosed, for example, in Patent Document 1 (JPA H10-127049). A reactor, which is utilized in an interleaved step-up circuit of this type, is disclosed, for example, in Patent Document 2 (JPA 2017-168587). Referring to FIG. 10, a reactor 800 of Patent Document 2 has two coils 810, a core 850 and a middle cover portion 880. The core 850 is a cast core which is formed by mixing soft magnetic alloy powder and resin followed by pouring the mixture in a predetermined mold. Each of the two coils 810 is embedded into the core 850. The middle cover portion 880 is made of resin and has an annular flat plate. The middle cover portion 880 is held between the two coils 810.

An electromagnetic property of the reactor 800 of Patent Document 2 is increased as a coupling coefficient of the two coils 810 is increased. In a case where a reactor similar to the reactor 800 of Patent Document 2 is utilized in an interleaved step-up circuit providing two output phases, it is known that the interleaved step-up circuit having a configuration, in which a step-up ratio (duty ratio) is 0.5 while a coupling coefficient of two coils is 1, is most preferred from a point of view of reducing ripple current. Additionally, when the duty ratio is set to a value far from 0.5 in this case, it is also known that ripple current is dramatically increased as the coupling coefficient thereof is increased.

On the other hand, there is a need for a step-up circuit having an available range of a step-up ratio which is suitable for actual use. As understood from above, in order that, in some range of a step-up ratio, a reactor has excellent magnetic properties while a step-up circuit with the reactor has reduced ripple current, a coupling coefficient of two coils of the reactor is required to be appropriately adjusted.

SUMMARY OF THE INVENTION

It is therefore an object of the present invention to provide a reactor which enables a coupling coefficient of two coils of the reactor to be appropriately adjusted. In addition, it is another object of the present invention to provide a step-up circuit which utilizes the reactor.

Through trial and error, the applicant has been found that, by adjusting a distance between two coils, a coupling coefficient of the two coils can be easily adjusted in a reactor comprising the two coils, an upper core part of high relative magnetic permeability, a lower core part of high relative magnetic permeability, an inner core part of low relative magnetic permeability and an outer core part of low relative magnetic permeability, wherein: the upper core part is arranged above the two coils; the lower core part is arranged below the two coils; the inner core part is arranged inward beyond the two coils; and the outer core part is arranged outward beyond the two coils. The present invention is based on this finding.

One aspect of the present invention provides a reactor comprising a first coil, a second coil and a core. Each of the first coil and the second coil is embedded in the core. The first coil comprises a first coil body. The first coil body has a first winding axis which extends in an up-down direction. The second coil comprises a second coil body. The second coil body has a second winding axis which extends in the up-down direction. In the up-down direction, the first coil body is positioned away from and above the second coil body. Each of the first coil and the second coil further has a single cross-section in a plane which includes both the first winding axis and the second winding axis. The cross-section has an outer circumference, an inner circumference, an upper end and a lower end. The inner circumference is positioned inward beyond the outer circumference in a radial direction perpendicular to the first winding axis. The upper end is positioned above the lower end in the up-down direction. The core has an outer core part, an inner core part, an upper core part, a lower core part and a middle core part. In the radial direction, the outer core part is positioned outward beyond any of the outer circumference of the cross-section of the first coil and the outer circumference of the cross-section of the second coil. In the radial direction, the inner core part is positioned inward beyond any of the inner circumference of the cross-section of the first coil and the inner circumference of the cross-section of the second coil. Each of the outer core part and the inner core part is positioned between the upper core part and the lower core part in the up-down direction. The outer core part has a first outer core part, a second outer core part and a third outer core part. The inner core part has a first inner core part, a second inner core part and a third inner core part. Each of the first outer core part and the first inner core part faces the first coil body in the radial direction. Each of the second outer core part and the second inner core part faces the middle core part in the radial direction. Each of the third outer core part and the third inner core part faces the second coil body in the radial direction. The upper core part is positioned above the upper end of the cross-section of the first coil in the up-down direction. The lower core part is positioned below the lower end of the cross-section of the second coil in the up-down direction. The middle core part is positioned between the first coil body and the second coil body in the up-down direction. The middle core part is positioned between the inner core part and the outer core part in the radial direction. The core is made of a first member and a second member. The second member has a relative permeability which is greater than a relative permeability of the first member. One of the first outer core part and the second outer core part is made of the first member. A remaining one of the first outer core part and the second outer core part is made of the first member or the second member. In a case where the first outer core part is made of the first member, the third outer core part is made of the first member. In a case where the first outer core part is made of the second member, the third outer core part is made of the second member. One of the first inner core part and the second inner core part is made of the first member. A remaining one of the first inner core part and the second inner core part is made of the first member or the second member. In a case where the first inner core part is made of the first member, the third inner core part is made of the first member. In a case where the first inner core part is made of the second member, the third inner core part is made of the second member. Each of the upper core part and the lower core part is made of the second member. The middle core part is made of the first member or the second member.

Another aspect of the present invention provides a step-up circuit comprising a power source, a first switching element, a second switching element, a first rectifier element, a second rectifier element and the reactor. The first switching element, the first rectifier element and the first coil of the reactor form a first step-up chopper circuit which chops an output of the power source to step-up voltage of the output. The second switching element, the second rectifier element and the second coil of the reactor form a second step-up chopper circuit which chops the output of the power source to step-up voltage of the output. The first step-up chopper circuit and the second step-up chopper circuit are connected in parallel with each other. The first step-up chopper circuit and the second step-up chopper circuit are operated in an interleaved manner.

In the core of the reactor of the present invention, one of the first outer core part and the second outer core part is made of the first member, and one of the first inner core part and the second inner core part is made of the first member. Additionally, in the core of the reactor of the present invention, each of the upper core part and the lower core part is made of the second member which has the relative permeability greater than the relative permeability of the first member. Accordingly, a coupling coefficient of the first coil and the second coil can be easily adjusted by adjusting a distance between the first coil body and the second coil body. In particular, the upper core part, which is made of the second member, is positioned above the first coil body, and the lower core part, which is made of the second member, is positioned below the second coil body. Thus, the reactor of the present invention is configured to have appropriate flux linkage between the first coil and the second coil.

An appreciation of the objectives of the present invention and a more complete understanding of its structure may be had by studying the following description of the preferred embodiment and by referring to the accompanying drawings.

Figure 1:
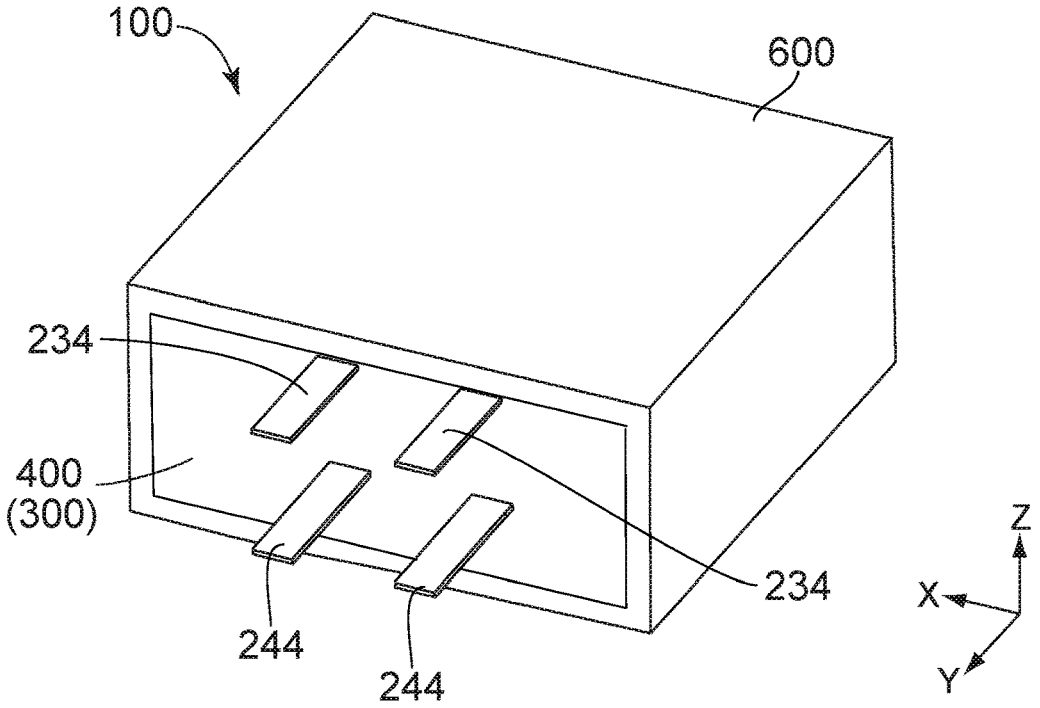
FIG. 1 is a perspective view showing a reactor according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
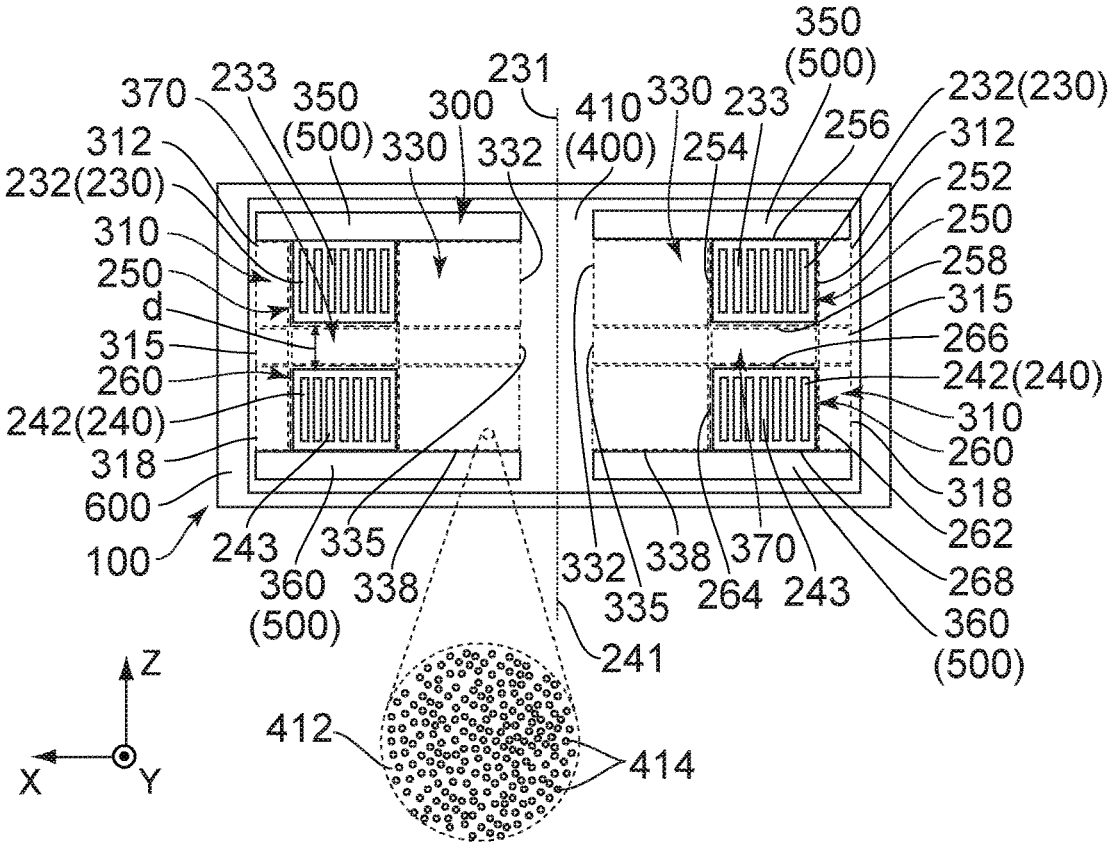
FIG. 2 is a cross-sectional view showing a structure of the reactor of FIG. 1.

As shown in FIG. 2, a reactor 100 according to a first embodiment of the present invention comprises a first coil 230, a second coil 240, a core 300 and a case 600. Each of the first coil 230 and the second coil 240 is embedded in the core 300.

Referring to FIGS. 1 and 2, the first coil 230 of the present embodiment comprises a first coil body 232 and two first end portions 234. The first coil body 232 has a first winding axis 231 which extends in an up-down direction. The two first end portions 234 extend from opposite ends, respectively, of the first coil body 232. In the present embodiment, the up-down direction is a Z-direction. Specifically, it is assumed that upward is a positive Z-direction while downward is a negative Z-direction. The first coil body 232 of the present embodiment is formed by winding a flat wire 233 flatwise. Although the first coil 230 of the present embodiment is a single-layer coil, the present invention is not limited thereto. The first coil 230 may be a multi-layer coil. For example, the first coil 230 may be an a-winding coil, namely, a double pancake coil.

As shown in FIG. 1, each of the first end portions 234 of the present embodiment extends to the outside of the core 300. More specifically, each of the first end portions 234 extends to the outside of the core 300 in a Y-direction perpendicular to the up-down direction. Although the first end portion 234 illustrated in FIG. 1 extends to the outside of the core 300 so that a longer side of the flat wire 233 is perpendicular to the up-down direction, the present invention is not limited thereto. For example, the first end portion 234 may extend to the outside of the core 300 so that a shorter side of the flat wire 233 is perpendicular to the up-down direction. Additionally, the first end portion 234 may be freely positioned on the core 300 in an XZ-plane.

Referring to FIGS. 1 and 2, the second coil 240 of the present embodiment comprises a second coil body 242 and two second end portions 244. The second coil body 242 has a second winding axis 241 which extends in the up-down direction. The two second end portions 244 extend from opposite ends, respectively, of the second coil body 242. The second coil body 242 of the present embodiment is formed by winding a flat wire 243 flatwise. Although the second coil 240 of the present embodiment is a single-layer coil, the present invention is not limited thereto. The second coil 240 may be a multi-layer coil. For example, the second coil 240 may be an a-winding coil, namely, a double pancake coil.

As shown in FIG. 1, each of the second end portions 244 of the present embodiment extends to the outside of the core 300. More specifically, each of the second end portions 244 extends to the outside of the core 300 in the Y-direction.

Although the second end portion 244 illustrated in FIG. 1 extends to the outside of the core 300 so that a longer side of the flat wire 243 is perpendicular to the up-down direction, the present invention is not limited thereto. For example, the second end portion 244 may extend to the outside of the core 300 so that a shorter side of the flat wire 243 is perpendicular to the up-down direction. Additionally, the second end portion 244 may be freely positioned on the core 300 in the XZ-plane.

As shown in FIG. 2, the first winding axis 231 and the second winding axis 241 of the present embodiment are the same axis. In the up-down direction, the first coil body 232 of the first coil 230 is positioned away from and above the second coil body 242 of the second coil 240.

As described above, in the reactor 100 of the present embodiment, the first coil 230 and the second coil 240, each of which is wound flatwise, are arranged in the up-down direction so that the first winding axis 231 and the second winding axis 241 are the same axis which extends in the up-down direction. Accordingly, in comparison with an assumption where two coils, each of which is wound edgewise, are arranged in a manner similar to that described above, the reactor 100 of the present embodiment has advantages as follows. It is easy to manufacture each of the first coil 230 and the second coil 240, and the reactor 100 has an improved heat dissipation character in the up-down direction and a reduced height.

As shown in FIG. 2, the first coil 230 of the present embodiment further has a single cross-section 250 in a plane which includes both the first winding axis 231 and the second winding axis 241. In addition, the second coil 240 of the present embodiment further has a single cross-section 260 in the plane which includes both the first winding axis 231 and the second winding axis 241.

As shown in FIG. 2, the cross-section 250 of the first coil body 232 of the first coil 230 of the present embodiment has an outer circumference 252, an inner circumference 254, an upper end 256 and a lower end 258. The outer circumference 252, the inner circumference 254, the upper end 256 and the lower end 258 define an outer edge of the cross-section 250.

As shown in FIG. 2, the inner circumference 254 of the present embodiment is positioned inward beyond the outer circumference 252 in a radial direction perpendicular to the first winding axis 231. The upper end 256 of the present embodiment is positioned above the lower end 258 in the up-down direction.

As shown in FIG. 2, the cross-section 260 of the second coil body 242 of the second coil 240 of the present embodiment has an outer circumference 262, an inner circumference 264, an upper end 266 and a lower end 268. The outer circumference 262, the inner circumference 264, the upper end 266 and the lower end 268 define an outer edge of the cross-section 260.

As shown in FIG. 2, the inner circumference 264 of the present embodiment is positioned inward beyond the outer circumference 262 in the radial direction perpendicular to the first winding axis 231. The upper end 266 of the present embodiment is positioned above the lower end 268 in the up-down direction.

Referring to FIG. 2, the reactor 100 is preferred to have a distance d between the first coil body 232 and the second coil body 242, wherein the distance d is within a range of 1 mm d 5 mm. More specifically, the reactor 100 is preferred to have a distance d between the lower end 258 of the cross-section 250 of the first coil 230 and the upper end 266 of the cross-section 260 of the second coil 240, wherein the distance d is within a range of 1 mm≤d≤5 mm.

Referring to FIG. 2, the core 300 of the present embodiment is made of a first member 400 and a second member 500. The second member 500 of the present embodiment is a dust core. The first member 400 of the present embodiment is a core made of a composite magnet 410 which comprises a hardened binder 412 and magnetic particles 414. The magnetic particles 414 are dispersed in the hardened binder 412.

In the present embodiment, the second member 500 has a relative permeability greater than a relative permeability of the first member 400. The first member 400 is preferred to have a relative permeability $\mu_L$ which is within a range of $3 \leq \mu_L \leq 40$. In addition, the second member 500 is preferred to have a relative permeability $\mu_h$ which is within a range of $40 < \mu_h \leq 300$.

As shown in FIG. 2, the core 300 of the present embodiment has an outer core part 310, an inner core part 330, an upper core part 350, a lower core part 360 and a middle core part 370. The upper core part 350 illustrated in FIG. 2 is divided into two pieces between which the first winding axis 231 is positioned. However, the present invention is not limited thereto. The upper core part 350 may be integrally formed to extend in an X-direction. Similar to the upper core part 350, the lower core part 360 illustrated in FIG. 2 is divided into two pieces between which the first winding axis 231 is positioned. However, the present invention is not limited thereto. The lower core part 360 may be integrally formed to extend in the X-direction.

As shown in FIG. 2, in the radial direction, the outer core part 310 of the present embodiment is positioned outward beyond the outer circumference 252 of the cross-section 250 of the first coil 230 while facing the outer circumference 252 of the cross-section 250 of the first coil 230. Additionally, in the radial direction, the outer core part 310 of the present embodiment is positioned outward beyond the outer circumference 262 of the cross-section 260 of the second coil 240 while facing the outer circumference 262 of the cross-section 260 of the second coil 240. The outer core part 310 is positioned below the upper core part 350 in the up-down direction. The outer core part 310 is in contact with a part of the upper core part 350 in the up-down direction. The outer core part 310 is positioned above the lower core part 360 in the up-down direction. The outer core part 310 is in contact with a part of the lower core part 360 in the up-down direction. The outer core part 310 is positioned between the upper core part 350 and the lower core part 360 in the up-down direction.

As shown in FIG. 2, the outer core part 310 of the present embodiment has a first outer core part 312, a second outer core part 315 and a third outer core part 318.

As shown in FIG. 2, the first outer core part 312 of the present embodiment is positioned below the upper core part 350 in the up-down direction. The first outer core part 312 is in contact with a part of the upper core part 350 in the up-down direction. An upper end of the first outer core part 312 is positioned at a position same as a position of the upper end 256 of the cross-section 250 of the first coil 230 in the up-down direction. A lower end of the first outer core part 312 is positioned at a position same as a position of the lower end 258 of the cross-section 250 of the first coil 230 in the up-down direction.

As shown in FIG. 2, the second outer core part 315 of the present embodiment is positioned below the first outer core part 312 in the up-down direction. The second outer core part 315 is in contact with the first outer core part 312 in the up-down direction. An upper end of the second outer core part 315 is positioned at a position same as a position of the lower end 258 of the cross-section 250 of the first coil 230 in the up-down direction. A lower end of the second outer core part 315 is positioned at a position same as a position of the upper end 266 of the cross-section 260 of the second coil 240 in the up-down direction.

As shown in FIG. 2, the third outer core part 318 of the present embodiment is positioned below the second outer core part 315 in the up-down direction. The third outer core part 318 is in contact with the second outer core part 315 in the up-down direction. An upper end of the third outer core part 318 is positioned at a position same as a position of the upper end 266 of the cross-section 260 of the second coil 240 in the up-down direction. A lower end of the third outer core part 318 is positioned at a position same as a position of the lower end 268 of the cross-section 260 of the second coil 240 in the up-down direction. The third outer core part 318 is positioned above the lower core part 360 in the up-down direction. The third outer core part 318 is in contact with a part of the lower core part 360 in the up-down direction.

As shown in FIG. 2, each of the first outer core part 312, the second outer core part 315 and the third outer core part 318 of the present embodiment is made of the first member 400. Specifically, the first outer core part 312, the second outer core part 315 and the third outer core part 318 are integrally made of common material. However, the present invention is not limited thereto. Specifically, the outer core part 310 may be configured that one of the first outer core part 312 and the second outer core part 315 is made of the first member 400 while a remaining one of the first outer core part 312 and the second outer core part 315 is made of the first member 400 or the second member 500. In a case where the first outer core part 312 is made of the first member 400 under this configuration, the third outer core part 318 is made of the first member 400. Otherwise, in a case where the first outer core part 312 is made of the second member 500 under this configuration, the third outer core part 318 is made of the second member 500.

As shown in FIG. 2, in the radial direction, the inner core part 330 of the present embodiment is positioned inward beyond the inner circumference 254 of the cross-section 250 of the first coil 230 while facing the inner circumference 254 of the cross-section 250 of the first coil 230. In the radial direction, the inner core part 330 is positioned inward beyond the inner circumference 264 of the cross-section 260 of the second coil 240 while facing the inner circumference 264 of the cross-section 260 of the second coil 240. The inner core part 330 is positioned below the upper core part 350 in the up-down direction. The inner core part 330 is in contact with a part of the upper core part 350 in the up-down direction. The inner core part 330 is positioned above the lower core part 360 in the up-down direction. The inner core part 330 is in contact with a part of the lower core part 360 in the up-down direction. The inner core part 330 is positioned between the upper core part 350 and the lower core part 360 in the up-down direction.

As shown in FIG. 2, the inner core part 330 of the present embodiment has a first inner core part 332, a second inner core part 335 and a third inner core part 338.

As shown in FIG. 2, the first inner core part 332 of the present embodiment is positioned below the upper core part 350 in the up-down direction. The first inner core part 332 is in contact with a part of the upper core part 350 in the up-down direction. An upper end of the first inner core part 332 is positioned at a position same as a position of the upper end 256 of the cross-section 250 of the first coil 230 in the up-down direction. A lower end of the first inner core part 332 is positioned at a position same as the lower end 258 of the cross-section 250 of the first coil 230 in the up-down direction.

As shown in FIG. 2, the second inner core part 335 of the present embodiment is positioned below the first inner core part 332 in the up-down direction. The second inner core part 335 is in contact with the first inner core part 332 in the up-down direction. An upper end of the second inner core part 335 is positioned at a position same as a position of the lower end 258 of the cross-section 250 of the first coil 230 in the up-down direction. A lower end of the second inner core part 335 is positioned at a position same as a position of the upper end 266 of the cross-section 260 of the second coil 240 in the up-down direction.

As shown in FIG. 2, the third inner core part 338 of the present embodiment is positioned below the second inner core part 335 in the up-down direction. The third inner core part 338 is in contact with the second inner core part 335 in the up-down direction. An upper end of the third inner core part 338 is positioned at a position same as a position of the upper end 266 of the cross-section 260 of the second coil 240 in the up-down direction. A lower end of the third inner core part 338 is positioned at a position same as a position of the lower end 268 of the cross-section 260 of the second coil 240 in the up-down direction. The third inner core part 338 is positioned above the lower core part 360 in the up-down direction. The third inner core part 338 is in contact with a part of the lower core part 360 in the up-down direction.

As shown in FIG. 2, each of the first outer core part 312 and the first inner core part 332 of the present embodiment faces the first coil body 232 in the radial direction. Each of the second outer core part 315 and the second inner core part 335 faces the middle core part 370 in the radial direction. Each of the third outer core part 318 and the third inner core part 338 faces the second coil body 242 in the radial direction.

As shown in FIG. 2, each of the first inner core part 332, the second inner core part 335 and the third inner core part 338 of the present embodiment is made of the first member 400. Specifically, the first inner core part 332, the second inner core part 335 and the third inner core part 338 are integrally made of common material. However, the present invention is not limited thereto. Specifically, the inner core part 330 may be configured that one of the first inner core part 332 and the second inner core part 335 is made of the first member 400 while a remaining one of the first inner core part 332 and the second inner core part 335 is made of the first member 400 or the second member 500. In a case where the first inner core part 332 is made of the first member 400 under this configuration, the third inner core part 338 is made of the first member 400. Otherwise, in a case where the first inner core part 332 is made of the second member 500 under this configuration, the third inner core part 338 is made of the second member 500.

As shown in FIG. 2, in the up-down direction, the upper core part 350 of the present embodiment is positioned above the upper end 256 of the cross-section 250 of the first coil 230 while facing the upper end 256 of the cross-section 250 of the first coil 230. The upper core part 350 projects outward and inward beyond the upper end 256 of the cross-section 250 of the first coil 230 in the radial direction. Specifically, an inner end of the upper core part 350 in the radial direction is positioned inward beyond the inner circumference 254 of the cross-section 250 of the first coil 230 in the radial direction, while an outer end of the upper core part 350 in the radial direction is positioned outward beyond the outer circumference 252 of the cross-section 250 of the first coil 230 in the radial direction. The upper core part 350 is made of the second member 500.

As shown in FIG. 2, in the up-down direction, the lower core part 360 of the present embodiment is positioned below the lower end 268 of the cross-section 260 of the second coil 240 while facing the lower end 268 of the cross-section 260 of the second coil 240. The lower core part 360 projects outward and inward beyond the lower end 268 of the cross-section 260 of the second coil 240 in the radial direction. Specifically, an inner end of the lower core part 360 in the radial direction is positioned inward beyond the inner circumference 264 of the cross-section 260 of the second coil 240 in the radial direction, while an outer end of the lower core part 360 in the radial direction is positioned outward beyond the outer circumference 262 of the cross-section 260 of the second coil 240 in the radial direction. The lower core part 360 is made of the second member 500.

As shown in FIG. 2, the middle core part 370 of the present embodiment is positioned between the first coil body 232 and the second coil body 242 in the up-down direction. The middle core part 370 is positioned between the inner core part 330 and the outer core part 310 in the radial direction. An upper end of the middle core part 370 is positioned at a position same as a position of the upper end of the second outer core part 315 in the up-down direction. The upper end of the middle core part 370 is positioned at a position same as a position of the upper end of the second inner core part 335 in the up-down direction. A lower end of the middle core part 370 is positioned at a position same as a position of the lower end of the second outer core part 315 in the up-down direction. The lower end of the middle core part 370 is positioned at a position same as a position of the lower end of the second inner core part 335 in the up-down direction. The middle core part 370 of the present embodiment is made of the first member 400. However, the present invention is not limited thereto. Specifically, the middle core part 370 may be made of the first member 400 or the second member 500. If the middle core part 370 is made of the first member 400 similar to the present embodiment, it is easy to form the middle core part 370 and it is easy to adjust the distance d between the first coil body 232 and the second coil body 242. Accordingly, the middle core part 370 is preferred to be made of the first member 400.

Referring to FIG. 2, the reactor 100 of the present embodiment is preferred to have a coil coupling coefficient k between the first coil body 232 and the second coil body 242, wherein, in zero magnetic field, the coil coupling coefficient k is within a range of $0.2 \leq k \leq 0.8$.

Referring to FIGS. 1 and 2, the case 600 of the present embodiment is made of aluminum or resin. In the reactor 100 of the present embodiment, the first coil 230, the second coil 240 and the core 300 are arranged in the case 600. However, the present invention is not limited thereto. Specifically, the reactor 100 may not have the case 600.

As described above, the reactor 100 of the present embodiment has the configuration as follows; each of the first winding axis 231 of the first coil 230 wound flatwise and the second winding axis 241 of the second coil 240 wound flatwise extends in the up-down direction so that the first winding axis 231 and the second winding axis 241 are the same axis, and the upper core part 350 is arranged above the first coil 230 while the lower core part 360 is arranged below the second coil 240. Accordingly, heat radiated from the first coil 230 and the second coil 240 can be rapidly transferred to the case 600 through the upper core part 350 and the lower core part 360 each of which is the dust core.

Second Embodiment

Figure 3:
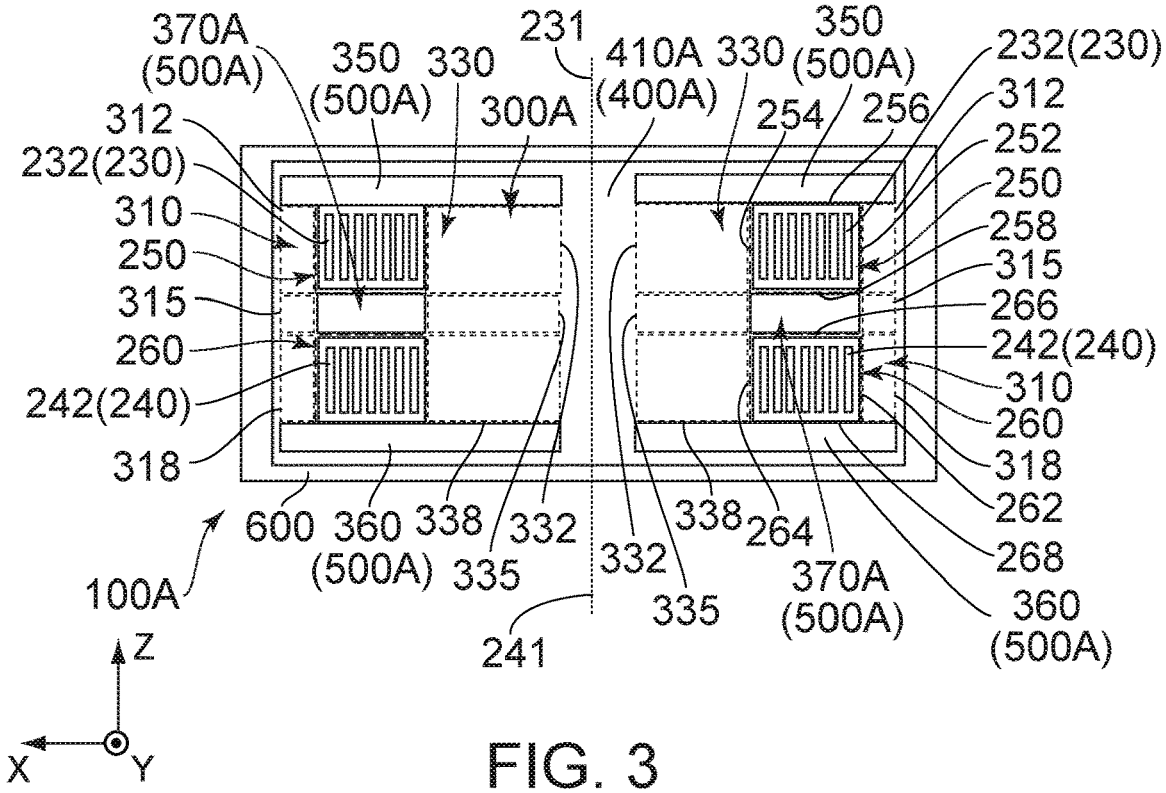
FIG. 3 is a cross-sectional view showing a structure of a reactor according to a second embodiment of the present invention.

As shown in FIG. 3, a reactor 100A according to a second embodiment of the present invention has a structure same as that of the reactor 100 according to the aforementioned first embodiment as shown in each of FIGS. 1 and 2 except for a core 300A. Accordingly, components of the reactor 100A shown in FIG. 3 which are same as those of the reactor 100 of the first embodiment are referred by using reference signs same as those of the reactor 100 of the first embodiment. As for directions and orientations in the present embodiment, expressions same as those of the first embodiment will be used hereinbelow.

Referring to FIG. 3, the core 300A of the present embodiment is made of a first member 400A and a second member 500A. The second member 500A of the present embodiment is a dust core. The first member 400A of the present embodiment is a core made of a composite magnet 410A which comprises a hardened binder 412 and magnetic particles 414. The magnetic particles 414 are dispersed in the hardened binder 412.

In the present embodiment, the second member 500A has a relative permeability greater than a relative permeability of the first member 400A. The first member 400A is preferred to have a relative permeability $\mu_L$ which is within a range of $3 \leq \mu_L \leq 40$. In addition, the second member 500A is preferred to have a relative permeability ph which is within a range of $40 < \mu_h \leq 300$.

As shown in FIG. 3, the core 300A of the present embodiment has an outer core part 310, an inner core part 330, an upper core part 350, a lower core part 360 and a middle core part 370A. The upper core part 350 illustrated in FIG. 3 is divided into two pieces between which a first winding axis 231 is positioned. However, the present invention is not limited thereto. The upper core part 350 may be integrally formed to extend in the X-direction. Similar to the upper core part 350, the lower core part 360 illustrated in FIG. 3 is divided into two pieces between which the first winding axis 231 is positioned. However, the present invention is not limited thereto. The lower core part 360 may be integrally formed to extend in the X-direction.

As shown in FIG. 3, the middle core part 370A of the present embodiment is positioned between a first coil body 232 and a second coil body 242 in the up-down direction. The middle core part 370A is positioned between the inner core part 330 and the outer core part 310 in the radial direction. The middle core part 370A of the present embodiment is made of the second member 500A.

More Specifically, as shown in FIG. 3, each of a second outer core part 315 and a second inner core part 335 faces the middle core part 370A in the radial direction. An upper end of the middle core part 370A is positioned at a position same as a position of an upper end of the second outer core part 315 in the up-down direction. The upper end of the middle core part 370A is positioned at a position same as a position of an upper end of the second inner core part 335 in the up-down direction. A lower end of the middle core part 370A is positioned at a position same as a position of a lower end of the second outer core part 315 in the up-down direction. The lower end of the middle core part 370A is positioned at a position same as a position of a lower end of the second inner core part 335 in the up-down direction.

Referring to FIG. 3, the reactor 100A of the present embodiment is preferred to have a coil coupling coefficient k between the first coil body 232 and the second coil body 242, wherein, in zero magnetic field, the coil coupling coefficient k is within a range of $0.2 \leq k \leq 0.8$.

Referring to FIG. 3, in the reactor 100A of the present embodiment, a first coil 230, a second coil 240 and the core 300A are arranged in a case 600.

Third Embodiment

Figure 4:
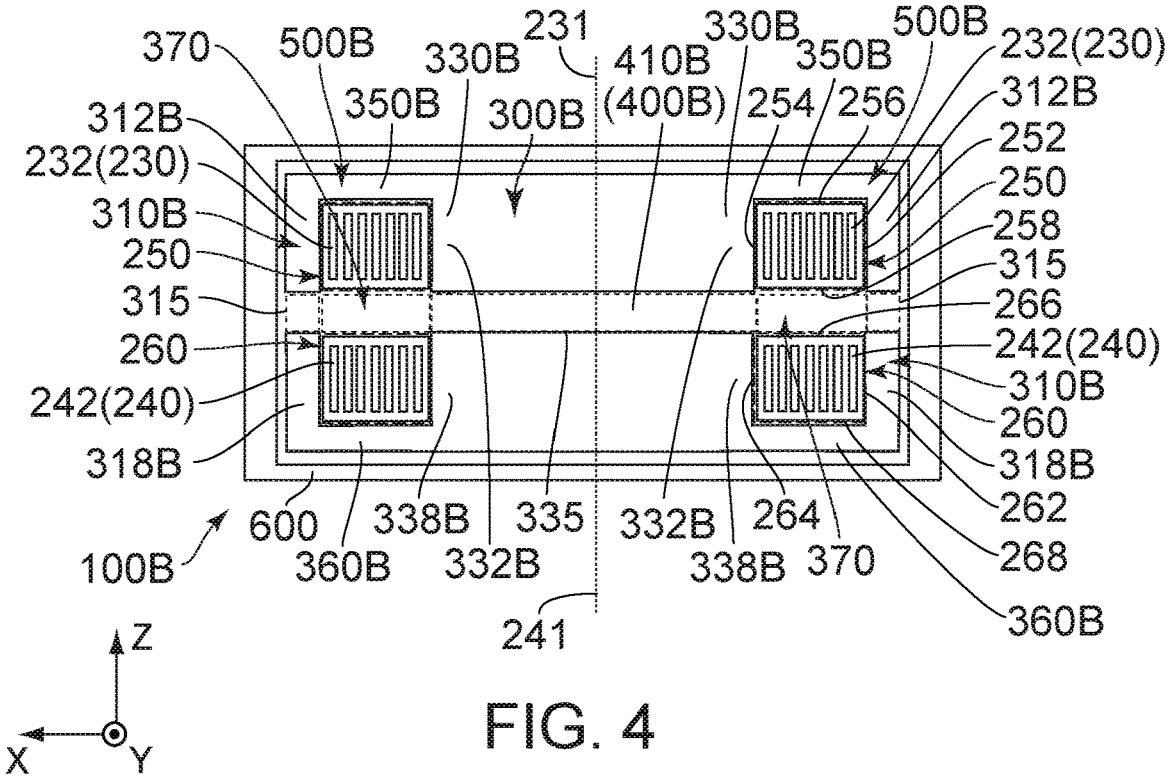
FIG. 4 is a cross-sectional view showing a structure of a reactor according to a third embodiment of the present invention.

As shown in FIG. 4, a reactor 100B according to a third embodiment of the present invention has a structure same as that of the reactor 100 according to the aforementioned first embodiment as shown in each of FIGS. 1 and 2 except for a core 300B. Accordingly, components of the reactor 100B shown in FIG. 4 which are same as those of the reactor 100 of the first embodiment are referred by using reference signs same as those of the reactor 100 of the first embodiment. As for directions and orientations in the present embodiment, expressions same as those of the first embodiment will be used hereinbelow.

Referring to FIG. 4, the core 300B of the present embodiment is made of a first member 400B and a second member 500B. The second member 500B of the present embodiment is a dust core. The first member 400B of the present embodiment is a core made of a composite magnet 410B which comprises a hardened binder 412 and magnetic particles 414. The magnetic particles 414 are dispersed in the hardened binder 412.

In the present embodiment, the second member 500B has a relative permeability greater than a relative permeability of the first member 400B. The first member 400B is preferred to have a relative permeability $\mu_L$ which is within a range of $3 \leq \mu_L \leq 40$. The second member 500B is preferred to have a relative permeability $\mu_h$ which is within a range of $40 < \mu_h \leq 300$.

As shown in FIG. 4, the core 300B of the present embodiment has an outer core part 310B, an inner core part 330B, an upper core part 350B, a lower core part 360B and a middle core part 370. The upper core part 350B illustrated in FIG. 4 is integrally formed to extend in the X-direction. However, the present invention is not limited thereto. The upper core part 350B may be divided into two pieces between which a first winding axis 231 is positioned. Similar to the upper core part 350B, the lower core part 360B illustrated in FIG. 4 is integrally formed to extend in the X-direction. However, the present invention is not limited thereto. The lower core part 360B may be divided into two pieces between which the first winding axis 231 is positioned.

As shown in FIG. 4, in the radial direction, the outer core part 310B of the present embodiment is positioned outward beyond an outer circumference 252 of a cross-section 250 of a first coil 230 while facing the outer circumference 252 of the cross-section 250 of the first coil 230. Additionally, in the radial direction, the outer core part 310B of the present embodiment is positioned outward beyond an outer circumference 262 of a cross-section 260 of a second coil 240 while facing the outer circumference 262 of the cross-section 260 of the second coil 240. The outer core part 310B is positioned below the upper core part 350B in the up-down direction. The outer core part 310B is coupled with the upper core part 350B in the up-down direction. The outer core part 310B is positioned above the lower core part 360B in the up-down direction. The outer core part 310B is coupled with the lower core part 360B in the up-down direction. The outer core part 310B is positioned between the upper core part 350B and the lower core part 360B in the up-down direction.

As shown in FIG. 4, the outer core part 310B of the present embodiment has a first outer core part 312B, a second outer core part 315 and a third outer core part 318B.

As shown in FIG. 4, the first outer core part 312B of the present embodiment is positioned below the upper core part 350B in the up-down direction. The first outer core part 312B is coupled with the upper core part 350B in the up-down direction. An upper end of the first outer core part 312B is positioned at a position same as a position of an upper end 256 of the cross-section 250 of the first coil 230 in the up-down direction. A lower end of the first outer core part 312B is positioned at a position same as a position of a lower end 258 of the cross-section 250 of the first coil 230 in the up-down direction.

As shown in FIG. 4, the second outer core part 315 of the present embodiment is positioned below the first outer core part 312B in the up-down direction. The second outer core part 315 is in contact with the first outer core part 312B in the up-down direction.

As shown in FIG. 4, the third outer core part 318B of the present embodiment is positioned below the second outer core part 315 in the up-down direction. The third outer core part 318B is in contact with the second outer core part 315 in the up-down direction. An upper end of the third outer core part 318B is positioned at a position same as a position of an upper end 266 of the cross-section 260 of the second coil 240 in the up-down direction. A lower end of the third outer core part 318B is positioned at a position same as a position of a lower end 268 of the cross-section 260 of the second coil 240 in the up-down direction. The third outer core part 318B is positioned above the lower core part 360B in the up-down direction. The third outer core part 318B is coupled with the lower core part 360B in the up-down direction.

As shown in FIG. 4, each of the first outer core part 312B and the third outer core part 318B is made of the second member 500B.

As shown in FIG. 4, in the radial direction, the inner core part 330B of the present embodiment is positioned inward beyond an inner circumference 254 of the cross-section 250 of the first coil 230 while facing the inner circumference 254 of the cross-section 250 of the first coil 230. In the radial direction, the inner core part 330B is positioned inward beyond an inner circumference 264 of the cross-section 260 of the second coil 240 while facing the inner circumference 264 of the cross-section 260 of the second coil 240. The inner core part 330B is positioned below the upper core part 350B in the up-down direction. The inner core part 330B is coupled with the upper core part 350B in the up-down direction. The inner core part 330B is positioned above the lower core part 360B in the up-down direction. The inner core part 330B is coupled with the lower core part 360B in the up-down direction. The inner core part 330B is positioned between the upper core part 350B and the lower core part 360B in the up-down direction.

As shown in FIG. 4, the inner core part 330B of the present embodiment has a first inner core part 332B, a second inner core part 335 and a third inner core part 338B.

As shown in FIG. 4, the first inner core part 332B of the present embodiment is positioned below the upper core part 350B in the up-down direction. The first inner core part 332B is coupled with the upper core part 350B in the up-down direction. An upper end of the first inner core part 332B is positioned at a position same as a position of the upper end 256 of the cross-section 250 of the first coil 230 in the up-down direction. A lower end of the first inner core part 332B is positioned at a position same as a position of the lower end 258 of the cross-section 250 of the first coil 230 in the up-down direction.

As shown in FIG. 4, the second inner core part 335 is positioned below the first inner core part 332B in the up-down direction. The second inner core part 335 is in contact with the first inner core part 332B in the up-down direction.

As shown in FIG. 4, the third inner core part 338B of the present embodiment is positioned below the second inner core part 335 in the up-down direction. The third inner core part 338B is in contact with the second inner core part 335 in the up-down direction. An upper end of the third inner core part 338B is positioned at a position same as a position of the upper end 266 of the cross-section 260 of the second coil 240 in the up-down direction. A lower end of the third inner core part 338B is positioned at a position same as a position of the lower end 268 of the cross-section 260 of the second coil 240 in the up-down direction. The third inner core part 338B is positioned above the lower core part 360B in the up-down direction. The third inner core part 338B is coupled with the lower core part 360B in the up-down direction.

As shown in FIG. 4, each of the first outer core part 312B and the first inner core part 332B faces a first coil body 232 in the radial direction. Each of the third outer core part 318B and the third inner core part 338B faces a second coil body 242 in the radial direction.

As shown in FIG. 4, each of the first inner core part 332B and the third inner core part 338B is made of the second member 500B.

As shown in FIG. 4, in the up-down direction, the upper core part 350B of the present embodiment is positioned above the upper end 256 of the cross-section 250 of the first coil 230 while facing the upper end 256 of the cross-section 250 of the first coil 230. The upper core part 350B projects outward and inward beyond the upper end 256 of the cross-section 250 of the first coil 230 in the radial direction. Specifically, an inner end of the upper core part 350B in the radial direction is positioned inward beyond the inner circumference 254 of the cross-section 250 of the first coil 230 in the radial direction, while an outer end of the upper core part 350B in the radial direction is positioned outward beyond the outer circumference 252 of the cross-section 250 of the first coil 230 in the radial direction. The upper core part 350B is made of the second member 500B.

As shown in FIG. 4, in the up-down direction, the lower core part 360B of the present embodiment is positioned below the lower end 268 of the cross-section 260 of the second coil 240 while facing the lower end 268 of the cross-section 260 of the second coil 240. The lower core part 360B projects outward and inward beyond the lower end 268 of the cross-section 260 of the second coil 240 in the radial direction. Specifically, an inner end of the lower core part 360B in the radial direction is positioned inward beyond the inner circumference 264 of the cross-section 260 of the second coil 240 in the radial direction, while an outer end of the lower core part 360B in the radial direction is positioned outward beyond the outer circumference 262 of the cross-section 260 of the second coil 240 in the radial direction. The lower core part 360B is made of the second member 500B.

As shown in FIG. 4, the middle core part 370 of the present embodiment is positioned between the inner core part 330B and the outer core part 310B in the radial direction.

Referring to FIG. 4, the reactor 100B of the present embodiment is preferred to have a coil coupling coefficient k between the first coil body 232 and the second coil body 242, wherein, in zero magnetic field, the coil coupling coefficient k is within a range of $0.2 \leq k \leq 0.8$.

Referring to FIG. 4, in the reactor 100B of the present embodiment, the first coil 230, the second coil 240 and the core 300B are arranged in a case 600.

Fourth Embodiment

Figure 5:
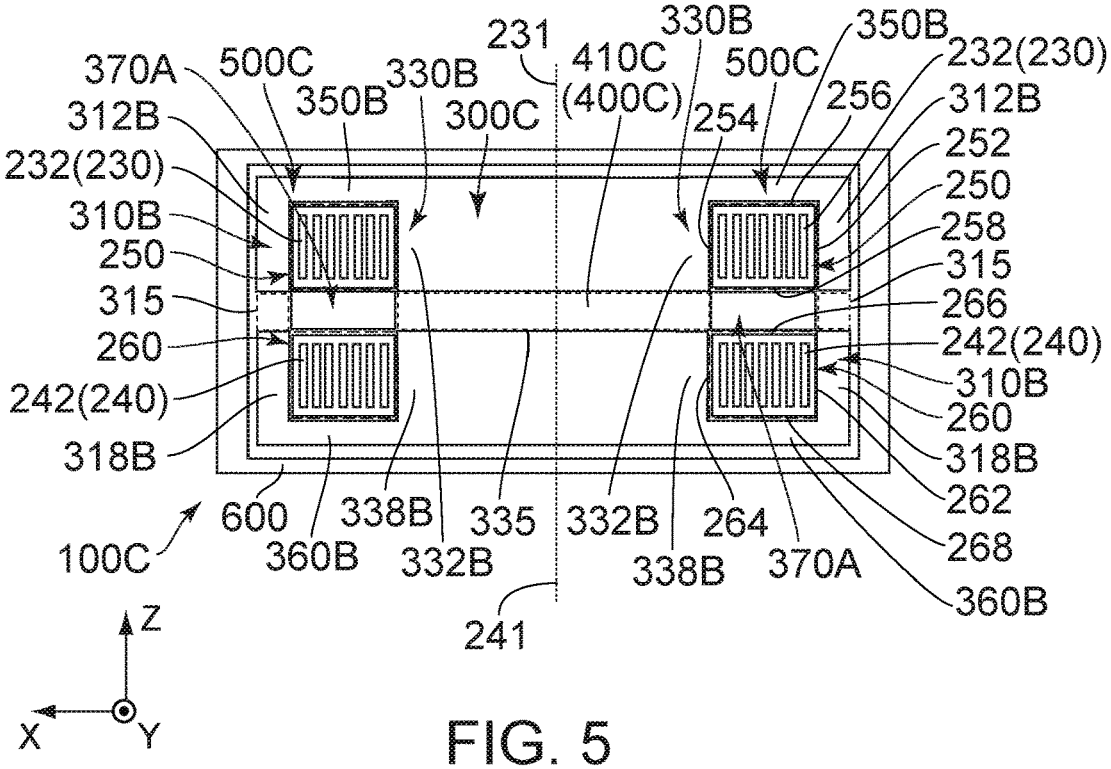
FIG. 5 is a cross-sectional view showing a structure of a reactor according to a fourth embodiment of the present invention.

As shown in FIG. 5, a reactor 100C according to a fourth embodiment of the present invention has a structure same as that of the reactor 100 according to the aforementioned first embodiment as shown in each of FIGS. 1 and 2 except for a core 300C. Accordingly, components of the reactor 100C shown in FIG. 5 which are same as those of the reactor 100 of the first embodiment are referred by using reference signs same as those of the reactor 100 of the first embodiment. As for directions and orientations in the present embodiment, expressions same as those of the first embodiment will be used hereinbelow.

Referring to FIG. 5, the core 300C of the present embodiment is made of a first member 400C and a second member 500C. The second member 500C of the present embodiment is a dust core. The first member 400C of the present embodiment is a core made of a composite magnet 410C which comprises a hardened binder 412 and magnetic particles 414. The magnetic particles 414 are dispersed in the hardened binder 412.

In the present embodiment, the second member 500C has a relative permeability greater than a relative permeability of the first member 400C. The first member 400C is preferred to have a relative permeability $\mu_L$ which is within a range of $3 \leq \mu_L \leq 40$. In addition, the second member 500C is preferred to have a relative permeability ph which is within a range of $40 < \mu_h \leq 300$.

As shown in FIG. 5, the core 300C of the present embodiment has an outer core part 310B, an inner core part 330B, an upper core part 350B, a lower core part 360B and a middle core part 370A. The outer core part 310B, the inner core part 330B, the upper core part 350B and the lower core part 360B of the present embodiment are similar to those of the third embodiment. Therefore, detailed explanation thereabout is omitted. In addition, the middle core part 370A is similar to that of the second embodiment. Therefore, detailed explanation thereabout is omitted. A relation between each of the outer core part 310B, the inner core part 330B, the upper core part 350B and the lower core part 360B, and the middle core part 370A are similar to the relation between each of the outer core part 310B, the inner core part 330B, the upper core part 350B and the lower core part 360B, and the middle core part 370 of the third embodiment. Therefore, detailed explanation thereabout is omitted. The upper core part 350B illustrated in FIG. 5 is integrally formed to extend in the X-direction. However, the present invention is not limited thereto. The upper core part 350B may be divided into two pieces between which a first winding axis 231 is positioned. Similar to the upper core part 350B, the lower core part 360B illustrated in FIG. 5 is integrally formed to extend in the X-direction. However, the present invention is not limited thereto. The lower core part 360B may be divided into two pieces between which the first winding axis 231 is positioned.

Referring to FIG. 5, the reactor 100C of the present embodiment is preferred to have a coil coupling coefficient k between a first coil body 232 and a second coil body 242, wherein, in zero magnetic field, the coil coupling coefficient k is within a range of $0.2 \leq k \leq 0.8$.

Referring to FIG. 5, in the reactor 100C of the present embodiment, a first coil 230, a second coil 240 and the core 300C are arranged in a case 600.

Fifth Embodiment

Figure 6:
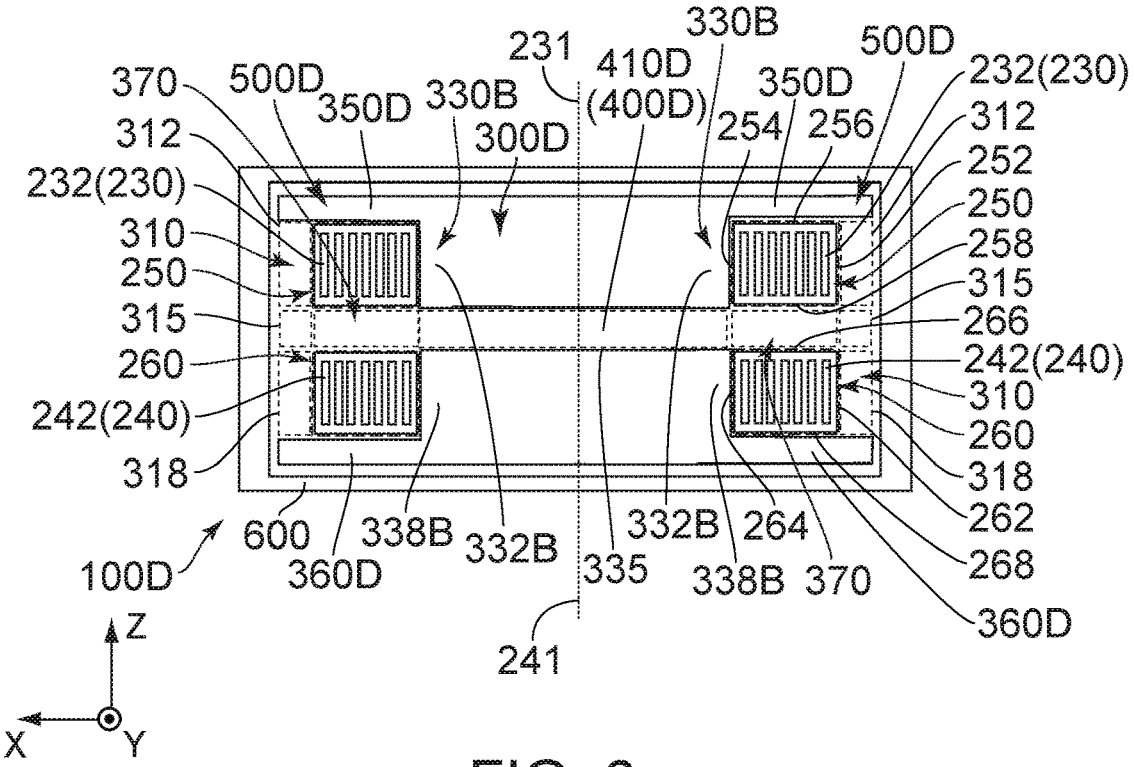
FIG. 6 is cross-sectional view showing a structure of a reactor according to a fifth embodiment of the present invention.

As shown in FIG. 6, a reactor 100D according to a fifth embodiment of the present invention has a structure same as that of the reactor 100 according to the aforementioned first embodiment as shown in each of FIGS. 1 and 2 except for a core 300D. Accordingly, components of the reactor 100D shown in FIG. 6 which are same as those of the reactor 100 of the first embodiment are referred by using reference signs same as those of the reactor 100 of the first embodiment. As for directions and orientations in the present embodiment, expressions same as those of the first embodiment will be used hereinbelow.

Referring to FIG. 6, the core 300D of the present embodiment is made of a first member 400D and a second member 500D. The second member 500D of the present embodiment is a dust core. The first member 400D of the present embodiment is a core made of a composite magnet 410D which comprises a hardened binder 412 and magnetic particles 414. The magnetic particles 414 are dispersed in the hardened binder 412.

In the present embodiment, the second member 500D has a relative permeability greater than a relative permeability of the first member 400D. The first member 400D is preferred to have a relative permeability $\mu_L$ which is within a range of $3 \leq \mu_L \leq 40$. In addition, the second member 500D is preferred to have a relative permeability ph which is within a range of $40 < \mu_h \leq 300$.

As shown in FIG. 6, the core 300D of the present embodiment has an outer core part 310, an inner core part 330B, an upper core part 350D, a lower core part 360D and a middle core part 370. The upper core part 350D illustrated in FIG. 6 is integrally formed to extend in the X-direction. However, the present invention is not limited thereto. The upper core part 350D may be divided into two pieces between which a first winding axis 231 is positioned. Similar to the upper core part 350D, the lower core part 360D illustrated in FIG. 6 is integrally formed to extend in the X-direction. However, the present invention is not limited thereto. The lower core part 360D may be divided into two pieces between which the first winding axis 231 is positioned.

As shown in FIG. 6, the outer core part 310 is positioned below the upper core part 350D in the up-down direction. The outer core part 310 is in contact with a part of the upper core part 350D in the up-down direction. The outer core part 310 is positioned above the lower core part 360D in the up-down direction. The outer core part 310 is in contact with a part of the lower core part 360D in the up-down direction. The outer core part 310 is positioned between the upper core part 350D and the lower core part 360D in the up-down direction.

As shown in FIG. 6, the outer core part 310 of the present embodiment has a first outer core part 312, a second outer core part 315 and a third outer core part 318.

As shown in FIG. 6, the first outer core part 312 of the present embodiment is positioned below the upper core part 350D in the up-down direction. The first outer core part 312 is in contact with a part of the upper core part 350D in the up-down direction.

As shown in FIG. 6, the third outer core part 318 is positioned above the lower core part 360D in the up-down direction. The third outer core part 318 is in contact with a part of the lower core part 360D in the up-down direction.

As shown in FIG. 6, in the radial direction, the inner core part 330B of the present embodiment is positioned inward beyond an inner circumference 254 of a cross-section 250 of a first coil 230 while facing the inner circumference 254 of the cross-section 250 of the first coil 230. In the radial direction, the inner core part 330B is positioned inward beyond an inner circumference 264 of a cross-section 260 of a second coil 240 while facing the inner circumference 264 of the cross-section 260 of the second coil 240. The inner core part 330B is positioned below the upper core part 350D in the up-down direction. The inner core part 330B is coupled with the upper core part 350D in the up-down direction. The inner core part 330B is positioned above the lower core part 360D in the up-down direction. The inner core part 330B is coupled with the lower core part 360D in the up-down direction. The inner core part 330B is positioned between the upper core part 350D and the lower core part 360D in the up-down direction.

As shown in FIG. 6, the inner core part 330B of the present embodiment has a first inner core part 332B, a second inner core part 335 and a third inner core part 338B.

As shown in FIG. 6, the first inner core part 332B of the present embodiment is positioned below the upper core part 350D in the up-down direction. The first inner core part 332B is coupled with the upper core part 350D in the up-down direction. An upper end of the first inner core part 332B is positioned at a position same as a position of an upper end 256 of the cross-section 250 of the first coil 230 in the up-down direction. A lower end of the first inner core part 332B is positioned at a position same as a position of a lower end 258 of the cross-section 250 of the first coil 230 in the up-down direction.

As shown in FIG. 6, the second inner core part 335 of the present embodiment is positioned below the first inner core part 332B in the up-down direction. The second inner core part 335 is in contact with the first inner core part 332B in the up-down direction.

As shown in FIG. 6, the third inner core part 338B of the present embodiment is positioned below the second inner core part 335 in the up-down direction. The third inner core part 338B is in contact with the second inner core part 335 in the up-down direction. An upper end of the third inner core part 338B is positioned at a position same as a position of an upper end 266 of the cross-section 260 of the second coil 240 in the up-down direction. A lower end of the third inner core part 338B is positioned at a position same as a position of a lower end 268 of the cross-section 260 of the second coil 240 in the up-down direction. The third inner core part 338B is positioned above the lower core part 360D in the up-down direction. The third inner core part 338B is coupled with the lower core part 360D in the up-down direction.

As shown in FIG. 6, each of the first outer core part 312 and the first inner core part 332B faces a first coil body 232 in the radial direction. Each of the third outer core part 318 and the third inner core part 338B faces a second coil body 242 in the radial direction.

As shown in FIG. 6, each of the first inner core part 332B and the third inner core part 338B is made of the second member 500D.

As shown in FIG. 6, in the up-down direction, the upper core part 350D of the present embodiment is positioned above the upper end 256 of the cross-section 250 of the first coil 230 while facing the upper end 256 of the cross-section 250 of the first coil 230. The upper core part 350D projects outward and inward beyond the upper end 256 of the cross-section 250 of the first coil 230 in the radial direction. Specifically, an inner end of the upper core part 350D in the radial direction is positioned inward beyond the inner circumference 254 of the cross-section 250 of the first coil 230 in the radial direction, while an outer end of the upper core part 350D in the radial direction is positioned outward beyond an outer circumference 252 of the cross-section 250 of the first coil 230 in the radial direction. The upper core part 350D is made of the second member 500D.

As shown in FIG. 6, in the up-down direction, the lower core part 360D of the present embodiment is positioned below the lower end 268 of the cross-section 260 of the second coil 240 while facing the lower end 268 of the cross-section 260 of the second coil 240. The lower core part 360D projects outward and inward beyond the lower end 268 of the cross-section 260 of the second coil 240 in the radial direction. Specifically, an inner end of the lower core part 360D in the radial direction is positioned inward beyond the inner circumference 264 of the cross-section 260 of the second coil 240 in the radial direction, while an outer end of the lower core part 360D in the radial direction is positioned outward beyond an outer circumference 262 of the cross-section 260 of the second coil 240 in the radial direction. The lower core part 360D is made of the second member 500D.

Referring to FIG. 6, the reactor 100D of the present embodiment is preferred to have a coil coupling coefficient k between the first coil body 232 and the second coil body 242, wherein, in zero magnetic field, the coil coupling coefficient k is within a range of $0.2 \leq k \leq 0.8$.

Referring to FIG. 6, in the reactor 100D of the present embodiment, the first coil 230, the second coil 240 and the core 300D are arranged in a case 600.

Sixth Embodiment

Figure 7:
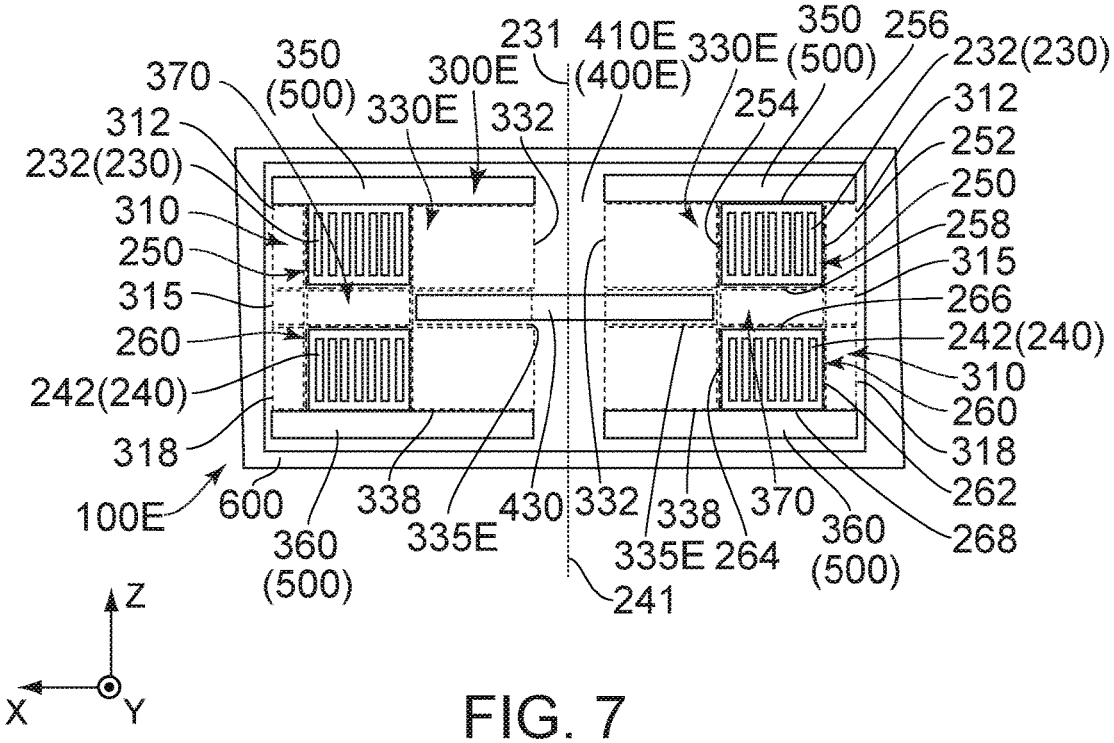
FIG. 7 is a cross-sectional view showing a structure of a reactor according to a sixth embodiment of the present invention.

As shown in FIG. 7, a reactor 100E according to a sixth embodiment of the present invention has a structure same as that of the reactor 100 according to the aforementioned first embodiment as shown in each of FIGS. 1 and 2 except for a core 300E. Accordingly, components of the reactor 100E shown in FIG. 7 which are same as those of the reactor 100 of the first embodiment are referred by using reference signs same as those of the reactor 100 of the first embodiment. As for directions and orientations in the present embodiment, expressions same as those of the first embodiment will be used hereinbelow.

Referring to FIG. 7, the core 300E of the present embodiment is made of a first member 400E and a second member 500. The first member 400E of the present embodiment has a core and a nonmagnetic gap 430, wherein the core is made of a composite magnet 410E which comprises a hardened binder 412 and magnetic particles 414, the magnetic particles 414 being dispersed in the hardened binder 412.

In the present embodiment, the second member 500 has a relative permeability greater than a relative permeability of the first member 400E. The first member 400E is preferred to have a relative permeability $\mu_L$ which is within a range of $3 \leq \mu_L \leq 40$.

As shown in FIG. 7, the core 300E of the present embodiment has an outer core part 310, an inner core part 330E, an upper core part 350, a lower core part 360 and a middle core part 370. The upper core part 350 illustrated in FIG. 7 is divided into two pieces between which a first winding axis 231 is positioned. However, the present invention is not limited thereto. The upper core part 350 may be integrally formed to extend in the X-direction. Similar to the upper core part 350, the lower core part 360 illustrated in FIG. 7 is divided into two pieces between which the first winding axis 231 is positioned. However, the present invention is not limited thereto. The lower core part 360 may be integrally formed to extend in the X-direction.

As shown in FIG. 7, in the radial direction, the inner core part 330E of the present embodiment is positioned inward beyond an inner circumference 254 of a cross-section 250 of a first coil 230 while facing the inner circumference 254 of the cross-section 250 of the first coil 230. In the radial direction, the inner core part 330E is positioned inward beyond an inner circumference 264 of a cross-section 260 of a second coil 240 while facing the inner circumference 264 of the cross-section 260 of the second coil 240. The inner core part 330E is positioned below the upper core part 350 in the up-down direction. The inner core part 330E is in contact with a part of the upper core part 350 in the up-down direction. The inner core part 330E is positioned above the lower core part 360 in the up-down direction. The inner core part 330E is in contact with a part of the lower core part 360 in the up-down direction. The inner core part 330E is positioned between the upper core part 350 and the lower core part 360 in the up-down direction.

As shown in FIG. 7, the inner core part 330E of the present embodiment has a first inner core part 332, a second inner core part 335E and a third inner core part 338.

As shown in FIG. 7, the second inner core part 335E of the present embodiment is positioned below the first inner core part 332 in the up-down direction. The second inner core part 335E is in contact with the first inner core part 332 in the up-down direction. An upper end of the second inner core part 335E is positioned at a position same as a position of a lower end 258 of the cross-section 250 of the first coil 230 in the up-down direction. A lower end of the second inner core part 335E is positioned at a position same as a position of an upper end 266 of the cross-section 260 of the second coil 240 in the up-down direction.

As shown in FIG. 7, the third inner core part 338 of the present embodiment is positioned below the second inner core part 335E in the up-down direction. The third inner core part 338 is in contact with the second inner core part 335E in the up-down direction.

As shown in FIG. 7, the second inner core part 335E of the present embodiment is provided with the nonmagnetic gap 430. The second inner core part 335E is made of the first member 400 except for the nonmagnetic gap 430.

As shown in FIG. 7, the middle core part 370 of the present embodiment is positioned between the inner core part 330E and the outer core part 310 in the radial direction. Each of the second outer core part 315 and the second inner core part 335E faces the middle core part 370 in the radial direction. An upper end of the middle core part 370 is positioned at a position same as a position of the upper end of the second inner core part 335E in the up-down direction. A lower end of the middle core part 370 is positioned at a position same as a position of the lower end of the second inner core part 335E in the up-down direction.

Referring to FIG. 7, the reactor 100E of the present embodiment is preferred to have a coil coupling coefficient k between a first coil body 232 and a second coil body 242, wherein, in zero magnetic field, the coil coupling coefficient k is within a range of $0.2 \leq k \leq 0.8$.

Referring to FIG. 7, in the reactor 100E of the present embodiment, the first coil 230, the second coil 240 and the core 300E are arranged in a case 600.

Seventh Embodiment

Figure 8:
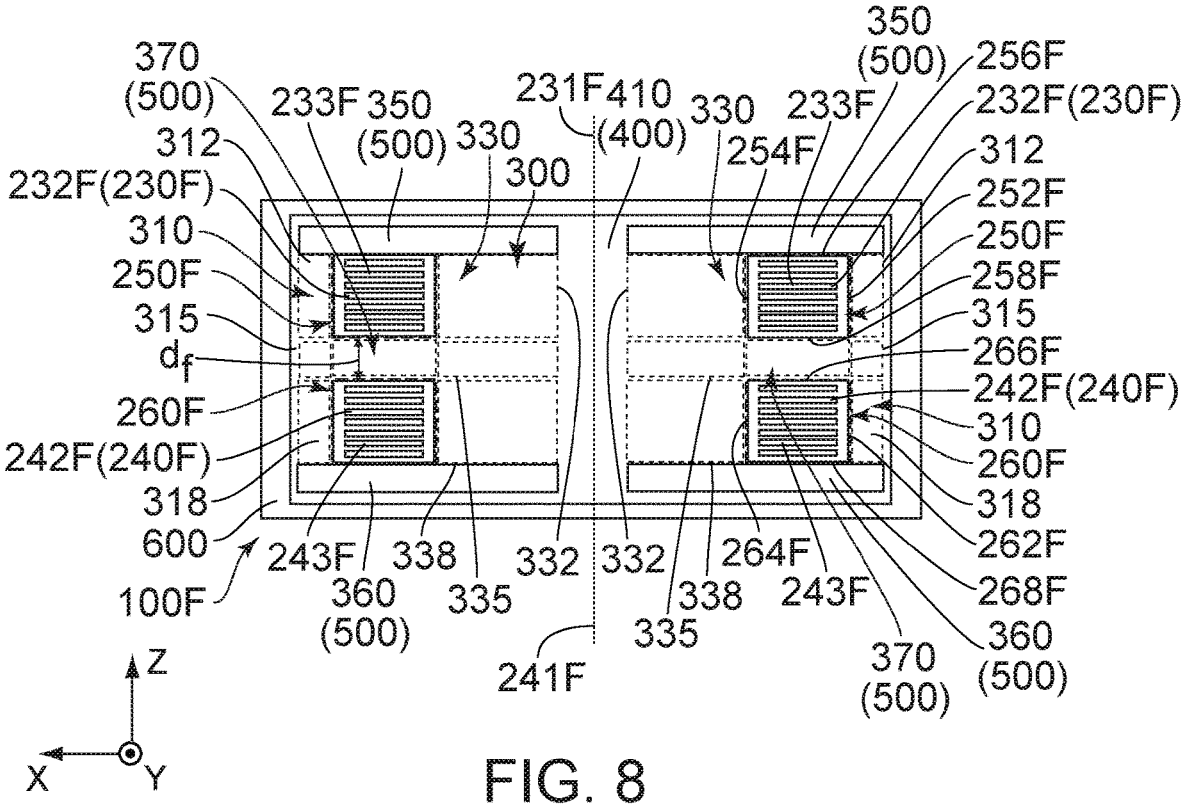
FIG. 8 is a cross-sectional view showing a structure of a reactor according to a seventh embodiment of the present invention.

As shown in FIG. 8, a reactor 100F according to a seventh embodiment of the present invention has a structure same as that of the reactor 100 according to the aforementioned first embodiment as shown in each of FIGS. 1 and 2 except for a first coil 230F and a second coil 240F. Accordingly, components of the reactor 100F shown in FIG. 8 which are same as those of the reactor 100 of the first embodiment are referred by using reference signs same as those of the reactor 100 of the first embodiment. As for directions and orientations in the present embodiment, expressions same as those of the first embodiment will be used hereinbelow.

As shown in FIG. 8, the reactor 100F of the present embodiment comprises the first coil 230F, the second coil 240F, a core 300 and a case 600. Each of the first coil 230F and the second coil 240F is embedded in the core 300.

Referring to FIG. 8, the first coil 230F of the present embodiment comprises a first coil body 232F and two first end portions (not shown). The first coil body 232F has a first winding axis 231F which extends in the up-down direction. The two first end portions extend from opposite ends, respectively, of the first coil body 232F. The first coil body 232F of the present embodiment is formed by winding a flat wire 233F edgewise. Each of the first end portions (not shown) of the present embodiment extends to the outside of the core 300.

Referring to FIG. 8, the second coil 240F of the present embodiment comprises a second coil body 242F and two second end portions (not shown). The second coil body 242F has a second winding axis 241 F which extends in the up-down direction. The two second end portions (not shown) extend from opposite ends, respectively, of the second coil body 242F. The second coil body 242F of the present embodiment is formed by winding a flat wire 243F edgewise. Each of the second end portions (not shown) of the present embodiment extends to the outside of the core 300.

As shown in FIG. 8, in the present embodiment, the first winding axis 231F and the second winding axis 241F are the same axis. The first coil body 232F of the first coil 230F is positioned away from and above the second coil body 242F of the second coil 240F in the up-down direction.

As shown in FIG. 8, the first coil 230F of the present embodiment further has a single cross-section 250F in a plane which includes the first winding axis 231F and the second winding axis 241F. In addition, the second coil 240F of the present embodiment further has a single cross-section 260F in the plane which includes the first winding axis 231 F and the second winding axis 241F.

As shown in FIG. 8, the cross-section 250F of the first coil body 232F of the first coil 230F of the present embodiment has an outer circumference 252F, an inner circumference 254F, an upper end 256F and a lower end 258F. The outer circumference 252F, the inner circumference 254F, the upper end 256F and the lower end 258F define an outer edge of the cross-section 250F.

As shown in FIG. 8, the inner circumference 254F of the present embodiment is positioned inward beyond the outer circumference 252F in the radial direction perpendicular to the first winding axis 231 F. The upper end 256F of the present embodiment is positioned above the lower end 258F in the up-down direction.

As shown in FIG. 8, the cross-section 260F of the second coil body 242F of the second coil 240F of the present embodiment has an outer circumference 262F, an inner circumference 264F, an upper end 266F and a lower end 268F. The outer circumference 262F, the inner circumference 264F, the upper end 266F and the lower end 268F define an outer edge of the cross-section 260F.

As shown in FIG. 8, the inner circumference 264F of the present embodiment is positioned inward beyond the outer circumference 262F in the radial direction perpendicular to the first winding axis 231 F. The upper end 266F of the present embodiment is positioned above the lower end 268F in the up-down direction.

Referring to FIG. 8, the reactor 100F is preferred to have a distance df between the first coil body 232F and the second coil body 242F, wherein the distance df is within a range of 1 mm df 5 mm. More specifically, the reactor 100F is preferred to have a distance df between the lower end 258F of the cross-section 250F of the first coil 230F and the upper end 266F of the cross-section 260F of the second coil 240F, wherein the distance df is within a range of 1 mm≤$d_f$≤5 mm.

As shown in FIG. 8, in the radial direction, an outer core part 310 of the present embodiment is positioned outward beyond the outer circumference 252F of the cross-section 250F of the first coil 230F while facing the outer circumference 252F of the cross-section 250F of the first coil 230F. Additionally, in the radial direction, the outer core part 310 of the present embodiment is positioned outward beyond the outer circumference 262F of the cross-section 260F of the second coil 240F while facing the outer circumference 262F of the cross-section 260F of the second coil 240F.

As shown in FIG. 8, an upper end of a first outer core part 312 is positioned at a position same as a position of the upper end 256F of the cross-section 250F of the first coil 230F in the up-down direction. A lower end of the first outer core part 312 is positioned at a position same as a position of the lower end 258F of the cross-section 250F of the first coil 230F in the up-down direction.

As shown in FIG. 8, an upper end of a second outer core part 315 is positioned at a position same as a position of the lower end 258F of the cross-section 250F of the first coil 230F in the up-down direction. A lower end of the second outer core part 315 is positioned at a position same as a position of the upper end 266F of the cross-section 260F of the second coil 240F in the up-down direction.

As shown in FIG. 8, an upper end of a third outer core part 318 is positioned at a position same as a position of the upper end 266F of the cross-section 260F of the second coil 240F in the up-down direction. A lower end of the third outer core part 318 is positioned at a position same as a position of the lower end 268F of the cross-section 260F of the second coil 240F in the up-down direction.

As shown in FIG. 8, in the radial direction, an inner core part 330 of the present embodiment is positioned inward beyond the inner circumference 254F of the cross-section 250F of the first coil 230F while facing the inner circumference 254F of the cross-section 250F of the first coil 230F. In the radial direction, the inner core part 330 is positioned inward beyond the inner circumference 264F of the cross-section 260F of the second coil 240F while facing the inner circumference 264F of the cross-section 260F of the second coil 240F.

As shown in FIG. 8, an upper end of a first inner core part 332 is positioned at a position same as a position of the upper end 256F of the cross-section 250F of the first coil 230F in the up-down direction. A lower end of the first inner core part 332 is positioned at a position same as the lower end 258F of the cross-section 250F of the first coil 230F in the up-down direction.

As shown in FIG. 8, an upper end of a second inner core part 335 is positioned at a position same as a position of the lower end 258F of the cross-section 250F of the first coil 230F in the up-down direction. A lower end of the second inner core part 335 is positioned at a position same as a position of the upper end 266F of the cross-section 260F of the second coil 240F in the up-down direction.

As shown in FIG. 8, an upper end of a third inner core part 338 is positioned at a position same as a position of the upper end 266F of the cross-section 260F of the second coil 240F in the up-down direction. A lower end of the third inner core part 338 is positioned at a position same as a position of the lower end 268F of the cross-section 260F of the second coil 240F in the up-down direction.

As shown in FIG. 8, each of the first outer core part 312 and the first inner core part 332 faces the first coil body 232F in the radial direction. Each of the third outer core part 318 and the third inner core part 338 faces the second coil body 242F in the radial direction.

As shown in FIG. 8, in the up-down direction, an upper core part 350 of the present embodiment is positioned above the upper end 256F of the cross-section 250F of the first coil 230F while facing the upper end 256F of the cross-section 250F of the first coil 230F. The upper core part 350 projects outward and inward beyond the upper end 256F of the cross-section 250F of the first coil 230F in the radial direction. Specifically, an inner end of the upper core part 350 in the radial direction is positioned inward beyond the inner circumference 254F of the cross-section 250F of the first coil 230F in the radial direction, while an outer end of the upper core part 350 in the radial direction is positioned outward beyond the outer circumference 252F of the cross-section 250F of the first coil 230F in the radial direction. The upper core part 350 illustrated in FIG. 8 is divided into two pieces between which the first winding axis 231F is positioned. However, the present invention is not limited thereto. The upper core part 350 may be integrally formed to extend in the X-direction.

As shown in FIG. 8, in the up-down direction, a lower core part 360 of the present embodiment is positioned below the lower end 268F of the cross-section 260F of the second coil 240F while facing the lower end 268F of the cross-section 260F of the second coil 240F. The lower core part 360 projects outward and inward beyond the lower end 268F of the cross-section 260F of the second coil 240F in the radial direction. Specifically, an inner end of the lower core part 360 in the radial direction is positioned inward beyond the inner circumference 264F of the cross-section 260F of the second coil 240F in the radial direction, while an outer end of the lower core part 360 in the radial direction is positioned outward beyond the outer circumference 262F of the cross-section 260F of the second coil 240F in the radial direction. The lower core part 360 illustrated in FIG. 8 is divided into two pieces between which the first winding axis 231F is positioned. However, the present invention is not limited thereto. The lower core part 360 may be integrally formed to extend in the X-direction.

As shown in FIG. 8, the middle core part 370 of the present embodiment is positioned between the first coil body 232F and the second coil body 242F in the up-down direction.

Referring to FIG. 8, the reactor 100F of the present embodiment is preferred to have a coil coupling coefficient k between the first coil body 232F and the second coil body 242F, wherein, in zero magnetic field, the coil coupling coefficient k is within a range of $0.2 \leq k \leq 0.8$.

Referring to FIG. 8, in the reactor 100F of the present embodiment, the first coil 230F, the second coil 240F and the core 300 are arranged in the case 600.

Although the specific explanation about the present invention is made above referring to the embodiments, the present invention is not limited thereto and is susceptible to various modifications and alternative forms.

Although the first coil 230, 230F and the second coil 240, 240F of the present embodiment is formed by winding the flat wire 233, 233F, 243 and 243F, each of the first coil 230, 230F and the second coil 240, 240F may be formed by winding any of a round wire and a square wire, or may be a surface coil.

Although the reactor 100, 100A, 100B, 100C, 100D, 100E, 100F has the two coils of the first coil 230, 230F and the second coil 240, 240F each having a single winding, each of the first coil 230, 230F and the second coil 240, 240F of the reactor 100, 100A, 100B, 100C, 100D, 100E, 100F may have multiple windings.

Although the reactor of the present invention is suitable especially for an element in an electrical system of a car, it is applicable to other coil components.

Upon manufacturing the reactor of the present invention, there is a probability that the reactor of the present invention has a gap between the first coil or the second coil and the dust core due to manufacturing tolerances of the dust core, the first coil and the second coil. Accordingly, the gap between the first coil or the second coil and the dust core may be filled with the first member.

[Calculations of DC Bias Characteristics by Simulation]

The applicant calculates, by simulation, DC bias characteristics of Examples 1 to 9 of the reactors 100, 100A, 100B, 100C and 100D of the present embodiments. Each of Examples 1 to 3 is an example of the reactor 100 of the first embodiment. Each of Examples 4 to 6 is an example of the reactor 100A of the second embodiment. Example 7 is an example of the reactor 100B of the third embodiment. Example 8 is an example of the reactor 100C of the fourth embodiment. Example 9 is an example of the reactor 100D of the fifth embodiment. Additionally, the applicant calculates, by simulation, DC bias characteristics of Comparative Examples 1 to 3 of reactors each of which has a configuration where the middle core part 370 is made of a non-magnetic material in the reactor 100 of the first embodiment. In the simulations, distances d each between the first coil body 232 and the second coil body 242 are set to values shown in Table 1. Table 1 shows calculated values of the DC bias characteristics of Examples 1 to 9 and Comparative Examples 1 to 3.

TABLE 1

| | distance d | L (μH) | | | | | | |
|---|---|---|---|---|---|---|---|---|
| | (mm) | Idc = 0 A | Idc = 50 A | Idc = 100 A | Idc = 130 A | Idc = 150 A | Idc = 200 A | Idc = 250 A |
| Example 1 | 1 | 49.3 | 46.9 | 44.5 | 43.1 | 42.3 | 40.5 | 39.2 |
| Example 2 | 3 | 51.2 | 47.3 | 43.0 | 40.5 | 38.9 | 35.4 | 32.8 |
| Example 3 | 5 | 52.3 | 47.7 | 42.5 | 39.3 | 37.2 | 32.5 | 28.7 |
| Example 4 | 1 | 60.2 | 46.0 | 42.1 | 41.2 | 40.7 | 39.7 | 38.7 |
| Example 5 | 3 | 64.5 | 51.2 | 38.9 | 35.6 | 34.3 | 31.9 | 30.2 |

TABLE 1-continued

| | distance d | L (μH) | | | | | | |
|---|---|---|---|---|---|---|---|---|
| | (mm) | Idc = 0 A | Idc = 50 A | Idc = 100 A | Idc = 130 A | Idc = 150 A | Idc = 200 A | Idc = 250 A |
| Example 6 | 5 | 65.8 | 54.0 | 40.9 | 34.4 | 31.5 | 27.0 | 24.3 |
| Example 7 | 3 | 118.3 | 105.7 | 93.0 | 86.6 | 82.7 | 75.1 | 69.6 |
| Example 8 | 3 | 172.4 | 94.2 | 78.8 | 74.0 | 71.4 | 66.2 | 61.6 |
| Example 9 | 3 | 81.6 | 74.6 | 67.3 | 63.4 | 60.9 | 56.0 | 52.6 |
| Comparative Example 1 | 1 | 47.6 | 47.0 | 46.4 | 46.1 | 45.8 | 45.2 | 44.6 |
| Comparative Example 2 | 3 | 44.0 | 43.4 | 42.7 | 42.3 | 42.0 | 41.3 | 40.6 |
| Comparative Example 3 | 5 | 41.3 | 40.5 | 39.8 | 39.4 | 39.1 | 38.3 | 37.5 |

As shown in Table 1, when DC current value ldc=0, Examples 1 to 3 of the first embodiment have self-inductances of 49.3 μH to 52.3 μH. In addition, when DC current value ldc=0, Examples 4 to 6 of the second embodiment have self-inductance of 60.2 μH to 65.8 μH. Furthermore, when DC current value ldc=0, Examples 7 and 8 of the third and fourth embodiments have self-inductances of 118.3 μH and 172.4 μH. Moreover, when DC current value ldc=0, Example 9 of the fifth embodiment has a self-inductance of 81.6 μH. On the contrary, as shown in Table 1, when DC current value ldc=0, Comparative Examples 1 to 3 have self-inductances of 41.3 μH to 47.6 μH. Accordingly, it is understood that Examples 1 to 9 have theself-inductances each greater than any of the self-inductances of Comparative Examples 1 to 3 when DC current value ldc=0.

As understood from Table 1, the self-inductances of Examples 1 to 4, 7 and 9 are not dramatically decreased as DC current value ldc is increased. Thus, Examples 1 to 4, 7 and 9 have excellent DC bias characteristics.

[Calculations of Coil Coupling Coefficients by Simulation]

The applicant calculates, by simulation, coil coupling coefficients of Examples 1 to 9 and Comparative Example 1 to 3. Table 2 shows calculated values of the coil coupling coefficients of Examples 1 to 9 and Comparative Examples 1 to 3.

TABLE 2

| | coil coupling coefficient (absolute value) | | | | | | |
|---|---|---|---|---|---|---|---|
| | Idc = 0 A | Idc = 50 A | Idc = 100 A | Idc = 130 A | Idc = 150 A | Idc = 200 A | Idc = 250 A |
| Example 1 | 0.78 | 0.81 | 0.85 | 0.87 | 0.88 | 0.90 | 0.91 |
| Example 2 | 0.58 | 0.61 | 0.66 | 0.69 | 0.71 | 0.77 | 0.81 |
| Example 3 | 0.45 | 0.47 | 0.51 | 0.53 | 0.56 | 0.61 | 0.66 |
| Example 4 | 0.46 | 0.78 | 0.90 | 0.91 | 0.92 | 0.92 | 0.93 |
| Example 5 | 0.28 | 0.40 | 0.65 | 0.74 | 0.77 | 0.82 | 0.83 |
| Example 6 | 0.19 | 0.24 | 0.36 | 0.47 | 0.54 | 0.63 | 0.68 |
| Example 7 | 0.77 | 0.80 | 0.84 | 0.87 | 0.88 | 0.91 | 0.92 |
| Example 8 | 0.36 | 0.75 | 0.88 | 0.90 | 0.91 | 0.92 | 0.92 |
| Example 9 | 0.69 | 0.73 | 0.78 | 0.81 | 0.83 | 0.87 | 0.89 |
| Comparative Example 1 | 0.97 | 0.97 | 0.96 | 0.96 | 0.96 | 0.96 | 0.96 |
| Comparative Example 2 | 0.92 | 0.92 | 0.92 | 0.92 | 0.92 | 0.92 | 0.92 |
| Comparative Example 3 | 0.88 | 0.87 | 0.87 | 0.87 | 0.87 | 0.87 | 0.87 |

As shown in Table 2, when DC current value ldc=0, Examples 1 to 3 of the first embodiment have coil coupling coefficients of 0.45 to 0.78. In addition, when DC current value ldc=0, Examples 4 to 6 of the second embodiment have coil coupling coefficients of 0.19 to 0.46. On the contrary, as shown in Table 1, when DC current value ldc=0, Comparative Examples 1 to 3 have coil coupling coefficients of 0.88 to 0.97. Accordingly, it is understood that the coil coupling coefficients of Comparative Examples 1 to 3 are not easily adjustable upon adjustment of the distance d between the first coil body 232 and the second coil body 242. In addition, it is also understood that the coil coupling coefficients of Examples 1 to 6 are easily adjustable by adjusting the distance d between the first coil body 232 and the second coil body 242.

Also, as shown in Table 2, when DC current value ldc is increased from 0 A to 250 A, the coil coupling coefficient of Example 1 are within a range of 0.78 to 0.91. In addition, when DC current value ldc is increased from 0 A to 250 A, the coil coupling coefficient of Example 2 is within a range of 0.58 to 0.81. Additionally, when DC current value ldc is increased from 0 A to 250 A, the coil coupling coefficient of Example 3 is within a range of 0.45 to 0.66. Furthermore, when DC current value ldc is increased from 0 A to 250 A, the coil coupling coefficient of Example 7 is within a range of 0.77 to 0.92. Moreover, when DC current value ldc is increased from 0 A to 250 A, the coil coupling coefficient of Example 9 is within a range of 0.69 to 0.89. Accordingly, each of the coil coupling coefficients of Examples 1, 2, 3, 7 and 9 is not dramatically increased as DC current value ldc is increased.

[Calculations of Ripple Currents by Simulation]

The applicant calculates, by simulation, ripple currents of Examples 1 to 9 and Comparative Examples 1 to 3. The simulation is made at 20 kHz frequency rate in a state where the first member 400, 400A, 400B, 400C, 400D has a relative permeability of 10 while the second member 500, 500A, 500B, 500C, 500D has a relative permeability of 100. In addition, the simulation is made at a first condition where an input voltage is 300V while an output voltage is 600V, and is also made at a second condition where the input voltage is 300V while the output voltage is 650V. A duty ratio of the first condition is 0.5 while a duty ratio of the second condition is about 0.54, wherein the duty ratio is calculated by a formula as follows: duty ratio=1−input voltage/output voltage. Table 3 shows calculated values of the ripple currents of Examples 1 to 9 and Comparative Examples 1 to 3.

TABLE 3

| | ripple current (A) | | ratio |
|---|---|---|---|
| | first condition (α) | second condition (β) | β/α |
| Example 1 | 42.7 | 69.8 | 1.6 |
| Example 2 | 46.2 | 59.7 | 1.3 |
| Example 3 | 49.4 | 59.4 | 1.2 |
| Example 4 | 42.6 | 51.5 | 1.2 |
| Example 5 | 45.6 | 51.8 | 1.1 |
| Example 6 | 47.8 | 53.3 | 1.1 |
| Example 7 | 17.9 | 28.4 | 1.6 |
| Example 8 | 16.0 | 18.6 | 1.2 |
| Example 9 | 27.1 | 38.7 | 1.4 |
| Comparative Example 1 | 40.1 | 216.9 | 5.4 |
| Comparative Example 2 | 44.3 | 128.8 | 2.9 |
| Comparative Example 3 | 48.4 | 105.2 | 2.2 |

As shown in Table 3, considering comparisons of the ripple current values (60 ) in the first condition with the ripple current values (β) in the second condition, it is understood that the ripple current values (β) of Comparative Examples 1 to 3 in the second condition are 105.2 to 216.9 which are much greater than the ripple current values (α) of Comparative Examples 1 to 3 in the first condition, and it is also understood that the ripple current values (β) of Examples 1 to 9 in the second condition are 18.6 to 69.8 which are not much greater than the ripple current values (α) of Examples 1 to 9 in the first condition. Additionally, regarding ratios (β/α) of the ripple current values (α) and the ripple current values (β), the ratios (β/α) of Examples 1 to 9 are 1.1 to 1.6 while the ratios (β/α) of Comparative Examples 1 to 3 are 2.2 to 5.4. Accordingly, it is understood that each of the ratios (β/α) of Examples 1 to 9 is less than any of the ratios (β/α) of Comparative Examples 1 to 3. Thus, in comparison with Comparative Examples 1 to 3, the ripple currents of Examples 1 to 9 are prevented from being increased when the duty ratio is changed from 0.5.

[Calculations of AC Copper Losses by Simulation]

The applicant calculates, by simulation, AC copper losses of Examples 1 to 9 and Comparative Examples 1 to 3. The simulation is made at the same frequency rate, the same state and the same conditions as those of the simulation of the ripple currents as described above. Table 4 shows calculated values of the AC copper losses of Examples 1 to 9 and Comparative Examples 1 to 3.

TABLE 4

| | AC copper loss (W) | | ratio |
|---|---|---|---|
| | first condition (γ) | second condition (δ) | δ/γ |
| Example 1 | 105.2 | 281.7 | 2.7 |
| Example 2 | 121.7 | 203.1 | 1.7 |
| Example 3 | 135.1 | 195.6 | 1.4 |
| Example 4 | 105.9 | 154.9 | 1.5 |
| Example 5 | 123.1 | 158.7 | 1.3 |
| Example 6 | 136.8 | 169.5 | 1.2 |
| Example 7 | 15.2 | 38.1 | 2.5 |
| Example 8 | 11.9 | 16.2 | 1.4 |
| Example 9 | 45.7 | 92.7 | 2.0 |
| Comparative Example 1 | 95.2 | 2791.1 | 29.3 |
| Comparative Example 2 | 98.2 | 830.5 | 8.5 |
| Comparative Example 3 | 103.6 | 488.9 | 4.7 |

As shown in Table 4, considering comparisons of the AC copper losses (γ) in the first condition with the AC copper losses (δ) in the second condition, it is understood that the AC copper losses (δ) of Comparative Examples 1 to 3 in the second condition are 488.9 to 2791.1 which are much greater than the AC copper losses (γ) of Comparative Examples 1 to 3 in the first condition, and it is also understood that the AC copper losses (δ) of Examples 1 to 9 in the second condition are 16.2 to 281.7 which are not much greater than the AC copper losses (γ) of Examples 1 to 9 in the first condition. Additionally, regarding ratios (δ/γ) of the ripple current values (γ) and the ripple currents values (δ), the ratios (δ/γ) of Examples 1 to 9 are 1.2 to 2.7 while the ratios (δ/γ) of Comparative Examples 1 to 3 are 4.7 to 29.3. Accordingly, it is understood that each of the ratios (δ/γ) of Examples 1 to 9 is less than any of the ratios (δ/γ) of Comparative Examples 1 to 3. Thus, in comparison with Comparative Examples 1 to 3, the AC copper losses of Examples 1 to 9 are prevented from being increased when the duty ratio is changed from 0.5. Especially, the ratio (δ/γ) of Example 6 is 1.2 which is the minimum value among the ratios (δ/γ) of Examples 1 to 9. Thus, it is understood that the AC copper loss of Example 6 is scarcely increased when the duty ratio is changed from 0.5.

[Step-Up Circuit]

A step-up circuit 700 is made by utilizing the reactor 100, 100A, 100B, 100C, 100D, 100E, 100F of the present embodiment. The step-up circuit 700 of the present embodiment is described below.

Figure 9:
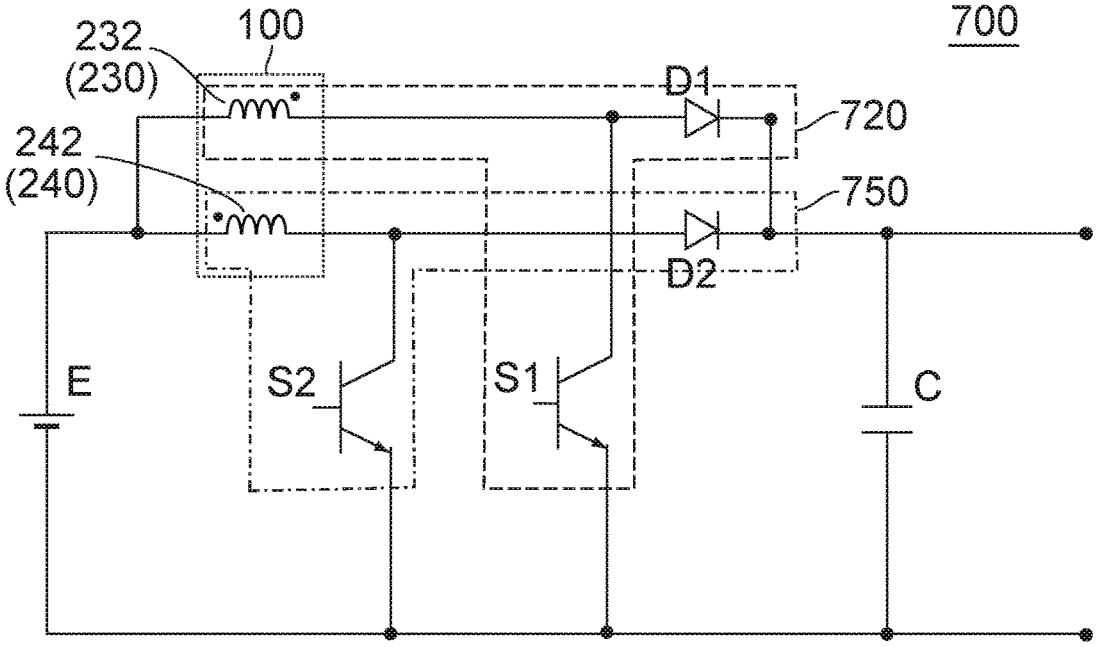
FIG. 9 is a circuit diagram showing a step-up circuit according to an embodiment of the present invention.
Figure 10:
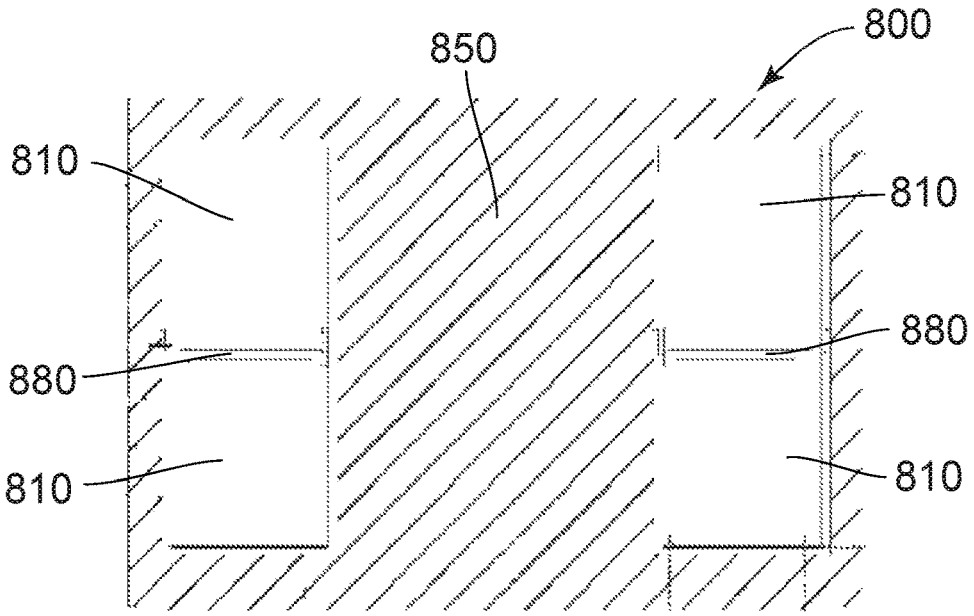
FIG. 10 PRIOR ART
FIG. 10 is a cross-sectional view showing a structure of a reactor of Patent Document 2.

As shown in FIG. 9, the step-up circuit 700 of the present embodiment comprises a power source E, a first switching element S1, a second switching element S2, a first rectifier element D1, a second rectifier element D2, the reactor 100 and a smoothing capacitor C. However, the present invention is not limited thereto. The step-up circuit 700 may be made by utilizing any of the reactors 100A, 100B, 100C, 100D, 100E, 100F instead of the reactor 100.

The power source E of the present embodiment is DC. However, the present invention is not limited thereto. The power source E may be AC.

Referring to FIG. 9, in the step-up circuit 700 of the present embodiment, the first switching element S1, the first rectifier element D1 and the first coil 230 of the reactor 100 form a first step-up chopper circuit 720 which chops an output of the power source E to step-up voltage of the output.

A semiconductor switching element such as a GBT (insulated-gate bipolar transistor) or a MOSFET (metal-oxide-semiconductor field-effect transistor) or the like may be used as the first switching element S1 of the present embodiment. In addition, any of a typical MOSFET using Si, a SJ MOSFET using Si (super junction MOSFET) and a wide-gap semiconductor using SiC, GaN or $Ga_2O_3$ also may be used as the first switching element S1 of the present embodiment.

Any of a Si pn junction diode, a SiC Schottky Barrier diode, a MOSFET for synchronous rectification and a body diode may be used as the first rectifier element D1 of the present embodiment. In addition, a circuit, which is formed by connecting any two or more of a Si pn junction diode, a SiC Schottky Barrier diode, a MOSFET for synchronous rectification and a body diode in parallel, also may be used as the first rectifier element D1 of the present embodiment.

Similarly, referring to FIG. 9, in the step-up circuit 700 of the present embodiment, the second switching element S2, the second rectifier element D2 and the second coil 240 of the reactor 100 form a second step-up chopper circuit 750 which chops the output of the power source E to step-up voltage of the output.

A semiconductor switching element such as a GBT (insulated-gate bipolar transistor) or a MOSFET (metal-oxide-semiconductor field-effect transistor) or the like may be used as the second switching element S2 of the present embodiment. In addition, any of a typical MOSFET using Si, a SJ MOSFET using Si (super junction MOSFET) and a wide-gap semiconductor using SiC, GaN, or $Ga_2O_3$ also may be used as the second switching element S2 of the present embodiment. The second switching element S2 may or may not be similar to the first switching element S1.

Any of a Si pn junction diode, a SiC Schottky Barrier diode, a MOSFET for synchronous rectification and a body diode may be used as the second rectifier element D2 of the present embodiment. In addition, a circuit, which is formed by connecting any two or more of a Si pn junction diode, a SiC Schottky Barrier diode, a MOSFET for synchronous-rectification and a body diode in parallel, also may be used as the second rectifier element D2 of the present embodiment. The second rectifier element D2 may or may not be similar to the first rectifier element D1.

In other words, the step-up circuit 700 of the present embodiment comprises the first step-up chopper circuit 720 and the second step-up chopper circuit 750. In the step-up circuit 700, the first step-up chopper circuit 720 and the second step-up chopper circuit 750 are connected in parallel with each other. In addition, the first step-up chopper circuit 720 and the second step-up chopper circuit 750 are operated in an interleaved manner.

The smoothing capacitor C of the present embodiment is configured to smooth output currents of the first step-up chopper circuit 720 and the second step-up chopper circuit 750.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A reactor comprising a first coil, a second coil and a core, wherein:

each of the first coil and the second coil is embedded in the core;

the first coil comprises a first coil body;

the first coil body has a first winding axis which extends in an up-down direction;

the second coil comprises a second coil body;

the second coil body has a second winding axis which extends in the up-down direction;

in the up-down direction, the first coil body is positioned away from and above the second coil body;

each of the first coil and the second coil further has a single cross-section in a plane which includes both the first winding axis and the second winding axis;

the cross-section has an outer circumference, an inner circumference, an upper end and a lower end;

the inner circumference is positioned inward beyond the outer circumference in a radial direction perpendicular to the first winding axis;

the upper end is positioned above the lower end in the up-down direction;

the core has an outer core part, an inner core part, an upper core part, a lower core part and a middle core part;

in the radial direction, the outer core part is positioned outward beyond any of the outer circumference of the cross-section of the first coil and the outer circumference of the cross-section of the second coil;

in the radial direction, the inner core part is positioned inward beyond any of the inner circumference of the cross-section of the first coil and the inner circumference of the cross-section of the second coil;

each of the outer core part and the inner core part is positioned between the upper core part and the lower core part in the up-down direction;

the outer core part has a first outer core part, a second outer core part and a third outer core part;

the inner core part has a first inner core part, a second inner core part and a third inner core part;

each of the first outer core part and the first inner core part faces the first coil body in the radial direction;

each of the second outer core part and the second inner core part faces the middle core part in the radial direction;

each of the third outer core part and the third inner core part faces the second coil body in the radial direction;

the upper core part is positioned above the upper end of the cross-section of the first coil in the up-down direction;

the lower core part is positioned below the lower end of the cross-section of the second coil in the up-down direction;

the middle core part is positioned between the first coil body and the second coil body in the up-down direction;

the middle core part is positioned between the inner core part and the outer core part in the radial direction;

the core is made of a first member and a second member;

the second member has a relative permeability which is greater than a relative permeability of the first member;

one of the first outer core part and the second outer core part is made of the first member;

a remaining one of the first outer core part and the second outer core part is made of the first member or the second member;

in a case where the first outer core part is made of the first member, the third outer core part is made of the first member;

in a case where the first outer core part is made of the second member, the third outer core part is made of the second member;

one of the first inner core part and the second inner core part is made of the first member;

a remaining one of the first inner core part and the second inner core part is made of the first member or the second member;

in a case where the first inner core part is made of the first member, the third inner core part is made of the first member;

in a case where the first inner core part is made of the second member, the third inner core part is made of the second member;

each of the upper core part and the lower core part is made of the second member; and the middle core part is made of the first member or the second member.

2. The reactor as recited in claim 1, wherein:

each of the first outer core part, the second outer core part and the third outer core part is made of the first member; and each of the first inner core part, the second inner core part and the third inner core part is made of the first member.

3. The reactor as recited in claim 1, wherein:

each of the first outer core part and the third outer core part is made of the second member;

the second outer core part is made of the first member;

each of the first inner core part and the third inner core part is made of the second member; and the second inner core part is made of the first member.

4. The reactor as recited in claim 1, wherein:

each of the first outer core part, the second outer core part and the third outer core part is made of the first member;

each of the first inner core part and the third inner core part is made of the second member; and the second inner core part is made of the first member.

5. The reactor as recited in claim 1, wherein each of the first coil body and the second coil body is formed by winding a flat wire flatwise.

6. The reactor as recited in claim 1, wherein each of the first coil body and the second coil body is formed by winding a flat wire edgewise.

7. The reactor as recited in claim 1, wherein:

the second member is a dust core; and the first member is a core made of a composite magnet which comprises a hardened binder and magnetic particles, the magnetic particles being dispersed in the hardened binder.

8. The reactor as recited in claim 1, wherein:

the reactor has a coil coupling coefficient k between the first coil body and the second coil body; and in zero magnetic field, the coil coupling coefficient k is within a range of $0.2 \leq K \leq 0.8$.

9. The reactor as recited in claim 1, wherein:

the reactor has a distance d between the first coil body and the second coil body; and the distance d is within a range of $1\ \text{mm} \leq d \leq 5\ \text{mm}$.

10. The reactor as recited in claim 1, wherein the first member has a relative permeability $\mu_L$ which is within a range of $3 \leq \mu_L \leq 40$.

11. The reactor as recited in claim 1, wherein the second member has a relative permeability $\mu_h$ which is within a range of $40 < \mu_h \leq 300$.

12. The reactor as recited in claim 1, wherein the first member has a nonmagnetic gap.

13. The reactor as recited in claim 1, wherein:

the reactor further has a case;

the case is made of aluminum or resin; and all of the first coil, the second coil and the core are arranged in the case.

14. A step-up circuit comprising a power source, a first switching element, a second switching element, a first rectifier element, a second rectifier element and the reactor as recited in claim 1, wherein:

the first switching element, the first rectifier element and the first coil of the reactor form a first step-up chopper circuit which chops an output of the power source to step-up voltage of the output;

the second switching element, the second rectifier element and the second coil of the reactor form a second step-up chopper circuit which chops the output of the power source to step-up voltage of the output;

the first step-up chopper circuit and the second step-up chopper circuit are connected in parallel with each other; and the first step-up chopper circuit and the second step-up chopper circuit are operated in an interleaved manner.

* * * * *